US008867976B2

(12) United States Patent
Fujimoto et al.

(10) Patent No.: US 8,867,976 B2
(45) Date of Patent: Oct. 21, 2014

(54) FIXING DEVICE, IMAGE FORMING APPARATUS INCORPORATING SAME, AND METHOD OF HEATING FIXING MEMBER

(75) Inventors: Ippei Fujimoto, Kanagawa (JP); Kenji Ishii, Kanagawa (JP); Masaaki Yoshikawa, Tokyo (JP); Hiroshi Yoshinaga, Chiba (JP); Naoki Iwaya, Tokyo (JP); Yoshiki Yamaguchi, Kanagawa (JP); Yutaka Ikebuchi, Kanagawa (JP); Tetsuo Tokuda, Kanagawa (JP); Takahiro Imada, Kanagawa (JP); Takamasa Hase, Kanagawa (JP); Toshihiko Shimokawa, Kanagawa (JP); Takuya Seshita, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 850 days.

(21) Appl. No.: 13/028,597

(22) Filed: Feb. 16, 2011

(65) Prior Publication Data

US 2011/0222930 A1 Sep. 15, 2011

(30) Foreign Application Priority Data

Mar. 10, 2010 (JP) ..... 2010-053123
Sep. 22, 2010 (JP) ..... 2010-211913

(51) Int. Cl.
*G03G 15/20* (2006.01)

(52) U.S. Cl.
CPC .... *G03G 15/2064* (2013.01); *G03G 2215/2035* (2013.01)
USPC ..... 399/329

(58) Field of Classification Search
CPC ..... G03G 15/2064; G03G 15/2067; G03G 15/2075; G03G 15/2078
USPC ..... 399/328, 329
See application file for complete search history.

(56) References Cited

U.S. PATENT DOCUMENTS 6,628,916 B2 9/2003 Yasui et al.
6,636,709 B2 10/2003 Furukawa et al.

(Continued)

FOREIGN PATENT DOCUMENTS

JP 03279988 A * 12/1991
JP 09190873 A * 7/1997

(Continued)

OTHER PUBLICATIONS

Hasenami et al. (JP 2010-152053 A), Jul. 2010, JPO Computer Translation.*

(Continued)

*Primary Examiner* — Erika J Villaluna
(74) *Attorney, Agent, or Firm* — Oblon, Spivak, McClelland, Maier & Neustadt, L.L.P.

(57) ABSTRACT

A fixing device includes a support member fixedly provided inside a loop formed by a fixing member to support a nip formation member provided inside the loop formed by the fixing member. A biasing member is provided between the support member and a heater support that supports a laminated heater that generates heat to be transmitted to the fixing member. The heater support thermally expands in a first direction due to heat generated by the laminated heater. The biasing member applies bias to the heater support in a second direction opposite the first direction and in which the heater support presses the laminated heater against an inner circumferential surface of the fixing member.

22 Claims, 11 Drawing Sheets

(56) References Cited

U.S. PATENT DOCUMENTS

| | | | |
|---|---|---|---|
| 6,778,790 | B2 | 8/2004 | Yoshinaga et al. |
| 6,778,804 | B2 | 8/2004 | Yoshinaga et al. |
| 6,785,505 | B2 | 8/2004 | Yasui et al. |
| 6,813,464 | B2 | 11/2004 | Amita et al. |
| 6,881,927 | B2 | 4/2005 | Yoshinaga et al. |
| 6,882,820 | B2 | 4/2005 | Shinshi et al. |
| 6,892,044 | B2 | 5/2005 | Yasui et al. |
| 6,937,827 | B2 | 8/2005 | Katoh et al. |
| 7,022,944 | B2 | 4/2006 | Yoshinaga et al. |
| 7,127,204 | B2 | 10/2006 | Satoh et al. |
| 7,151,907 | B2 | 12/2006 | Yoshinaga |
| 7,239,838 | B2 | 7/2007 | Sato et al. |
| 7,242,897 | B2 | 7/2007 | Satoh et al. |
| 7,313,353 | B2 | 12/2007 | Satoh et al. |
| 7,379,698 | B2 | 5/2008 | Yoshinaga |
| 7,437,111 | B2 | 10/2008 | Yamada et al. |
| 7,454,151 | B2 | 11/2008 | Satoh et al. |
| 7,466,949 | B2 | 12/2008 | Satoh et al. |
| 7,509,085 | B2 | 3/2009 | Yoshinaga et al. |
| 7,546,049 | B2 | 6/2009 | Ehara et al. |
| 7,570,910 | B2 | 8/2009 | Ishii |
| 7,603,071 | B2 | 10/2009 | Sugiura et al. |
| 7,702,271 | B2 | 4/2010 | Yamada et al. |
| 7,783,240 | B2 | 8/2010 | Ito et al. |
| 7,796,933 | B2 | 9/2010 | Ueno et al. |
| 7,801,457 | B2 | 9/2010 | Seo et al. |
| 7,840,151 | B2 | 11/2010 | Fujimoto |
| 2006/0029411 | A1 | 2/2006 | Ishii et al. |
| 2006/0257183 | A1 | 11/2006 | Ehara et al. |
| 2007/0014600 | A1 | 1/2007 | Ishii et al. |
| 2007/0212139 | A1 | 9/2007 | Sugiura et al. |
| 2008/0063443 | A1 | 3/2008 | Yoshinaga et al. |
| 2008/0253789 | A1 | 10/2008 | Yoshinaga et al. |
| 2008/0317532 | A1 | 12/2008 | Ehara et al. |
| 2009/0067902 | A1 | 3/2009 | Yoshinaga et al. |
| 2009/0123201 | A1 | 5/2009 | Ehara et al. |
| 2009/0123202 | A1 | 5/2009 | Yoshinaga et al. |
| 2009/0148204 | A1 | 6/2009 | Yoshinaga et al. |
| 2009/0148205 | A1 | 6/2009 | Seo et al. |
| 2009/0169232 | A1 | 7/2009 | Kunii et al. |
| 2009/0245865 | A1 | 10/2009 | Shinshi et al. |
| 2009/0245897 | A1 | 10/2009 | Seo et al. |
| 2009/0297197 | A1 | 12/2009 | Hase |
| 2010/0061753 | A1 | 3/2010 | Hase |
| 2010/0074667 | A1 | 3/2010 | Ehara et al. |
| 2010/0092220 | A1 | 4/2010 | Hasegawa et al. |
| 2010/0092221 | A1 | 4/2010 | Shinshi et al. |
| 2010/0202809 | A1 | 8/2010 | Shinshi et al. |
| 2010/0290822 | A1 | 11/2010 | Hasegawa et al. |
| 2010/0303521 | A1 | 12/2010 | Ogawa et al. |
| 2011/0026988 | A1 | 2/2011 | Yoshikawa et al. |

FOREIGN PATENT DOCUMENTS

| | | | |
|---|---|---|---|
| JP | 10-213984 | | 8/1998 |
| JP | 2884714 | | 2/1999 |
| JP | 3298354 | | 4/2002 |
| JP | 3592485 | | 9/2004 |
| JP | 2004-286929 | | 10/2004 |
| JP | 2007-334205 | | 12/2007 |
| JP | 2008-70736 | | 3/2008 |
| JP | 2008-158482 | | 7/2008 |
| JP | 2008-216928 | | 9/2008 |
| JP | 2009-3410 | | 1/2009 |
| JP | 2010152053 | A * | 7/2010 |

OTHER PUBLICATIONS

U.S. Appl. No. 12/805,818, filed Aug. 20, 2010.
U.S. Appl. No. 12/876,589, filed Sep. 7, 2010, Yoshiki Yamaguchi, et al.
U.S. Appl. No. 12/879,875, filed Sep. 10, 2010, Ippei Fujimoto, et al.
U.S. Appl. No. 12/852,079, filed Aug. 6, 2010, Akira Shinshi, et al.
U.S. Appl. No. 12/923,032, filed Aug. 30, 2010.
U.S. Appl. No. 12/923,272, filed Sep. 13, 2010.
U.S. Appl. No. 12/881,862, filed Sep. 14, 2010, Takamasa Hase, et al.
U.S. Appl. No. 12/888,980, filed Sep. 23, 2010, Yoshiki Yamaguchi, et al.
U.S. Appl. No. 12/923,231, filed Sep. 10, 2010.
U.S. Appl. No. 12/923,176, filed Sep. 8, 2010.
U.S. Appl. No. 12/874,734, filed Sep. 2, 2010, Akira Shinshi, et al.
U.S. Appl. No. 12/861,255, filed Aug. 23, 2010, Satoshi Ueno, et al.
U.S. Appl. No. 12/881,547, filed Sep. 14, 2010, Naoki Iwaya, et al.
U.S. Appl. No. 12/849,404, filed Aug. 3, 2010, Toshihiko Shimokawa, et al.
U.S. Appl. No. 12/878,480, filed Sep. 9, 2010, Yoshiki Yamaguchi, et al.
U.S. Appl. No. 12/880,327, filed Sep. 13, 2010, Ryota Yamashina, et al.
U.S. Appl. No. 12/857,953, filed Aug. 17, 2010, Masaaki Yoshikawa, et al.
U.S. Appl. No. 12/893,361, filed Sep. 29, 2010, Kenichi Hasegawa, et al.
U.S. Appl. No. 12/878,557, filed Sep. 9, 2010, Akira Shinshi, et al.
U.S. Appl. No. 12/946,276, filed Nov. 15, 2010, Yoshiki Yamaguchi, et al.
U.S. Appl. No. 12/946,347, filed Nov. 15, 2010, Kenji Ishii, et al.
U.S. Appl. No. 13/026,945, filed Feb. 14, 2011, Kenji Ishii, et al.

* cited by examiner

FIXING DEVICE, IMAGE FORMING APPARATUS INCORPORATING SAME, AND METHOD OF HEATING FIXING MEMBER

CROSS-REFERENCE TO RELATED APPLICATIONS

The present application is based on and claims priority to Japanese Patent Application Nos. 2010-053123, filed on Mar. 10, 2010, and 2010-211913, filed on Sep. 22, 2010, in the Japan Patent Office, each of which is hereby incorporated herein by reference in its entirety.

BACKGROUND OF THE INVENTION

1. Field of the Invention

Exemplary aspects of the present invention relate to a fixing device, an image forming apparatus, and a method of heating a fixing member, and more particularly, to a fixing device for fixing a toner image on a recording medium, an image forming apparatus including the fixing device, and a method of heating a fixing member that fixes a toner image on a recording medium.

2. Description of the Related Art

Related-art image forming apparatuses, such as copiers, facsimile machines, printers, or multifunction printers having at least one of copying, printing, scanning, and facsimile functions, typically form an image on a recording medium according to image data. Thus, for example, a charger uniformly charges a surface of an image carrier; an optical writer emits a light beam onto the charged surface of the image carrier to form an electrostatic latent image on the image carrier according to the image data; a development device supplies toner to the electrostatic latent image formed on the image carrier to make the electrostatic latent image visible as a toner image; the toner image is directly transferred from the image carrier onto a recording medium or is indirectly transferred from the image carrier onto a recording medium via an intermediate transfer member; a cleaner then cleans the surface of the image carrier after the toner image is transferred from the image carrier onto the recording medium; finally, a fixing device applies heat and pressure to the recording medium bearing the toner image to fix the toner image on the recording medium, thus forming the image on the recording medium.

The fixing device used in such image forming apparatuses may include a flexible, endless fixing belt formed into a loop and a resistant heat generator provided inside the loop formed by the fixing belt to heat the fixing belt, to shorten a warm-up time or a time to first print (hereinafter also "first print time"). Specifically, the resistant heat generator faces the inner circumferential surface of the fixing belt across a slight gap through which radiation heat generated by the resistant heat generator is transmitted to the fixing belt quickly. A pressing roller presses against a nip formation member also provided inside the loop formed by the fixing belt via the fixing belt to form a nip between the fixing belt and the pressing roller through which the recording medium bearing the toner image passes. As the recording medium bearing the toner image passes through the nip, the fixing belt, heated by radiation heat generated by the resistant heat generator, and the pressing roller together apply heat and pressure to the recording medium to fix the toner image on the recording medium.

With the above configuration, the slight gap provided between the resistant heat generator and the fixing belt prevents wear of the resistant heat generator and the fixing belt while at the same time providing the shortened warm-up time and the shortened first print time described above. Accordingly, even when the fixing belt rotates at a high speed, the resistant heat generator heats the fixing belt to a desired fixing temperature with reduced wear of the fixing belt and the resistant heat generator.

However, the fixing device including the resistant heat generator and the fixing belt has a drawback in that rotation and vibration of the pressing roller repeatedly applies mechanical stress to the resistant heat generator via the fixing belt, which bends the resistant heat generator. The repeated bending of the resistant heat generator causes fatigue failure and concomitant breakage or disconnection of the wiring of the resistant heat generator, resulting in faulty heating of the fixing belt.

To address this problem, the fixing device may further include a support member that supports the resistant heat generator and the nip formation member so that the resistant heat generator resists the mechanical stress applied by the pressing roller. However, since a lubricant (e.g., grease or oil) is applied between the fixing belt and the nip formation member to reduce friction therebetween, the lubricant may have the effect of increasing rotational torque of a driver that drives and rotates the pressing roller. Specifically, when the fixing device is not yet warmed up, the lubricant is also not warmed and therefore has an increased viscosity that increases frictional resistance between the nip formation member and the fixing belt sliding over the nip formation member.

To address this problem, pressure applied by the pressing roller to the fixing belt may be changed based on the temperature of the fixing belt detected by a thermistor. For example, the pressing roller applies reduced pressure to the fixing belt at a low temperature of the fixing belt, which increases the viscosity of the lubricant, and applies increased pressure to the fixing belt at a high temperature of the fixing belt, which reduces the viscosity of the lubricant. However, this configuration may require a complicated pressure adjustment mechanism that changes the pressure applied by the pressing roller in multiple steps based on the temperature detected by the thermistor as well as a complicated control mechanism to control the pressure adjustment mechanism.

Alternatively, a spring may be used to press the resistant heat generator against the fixing belt with increased pressure that reduces thermal resistance between the fixing belt and the resistant heat generator contacting each other. However, this configuration may also require a complicated pressure adjustment mechanism that changes bias applied by the spring in accordance with increased frictional resistance between the resistant heat generator and the fixing belt sliding over the resistant heat generator caused by the increased viscosity of the lubricant at a low temperature.

BRIEF SUMMARY OF THE INVENTION

This specification describes below an improved fixing device. In one exemplary embodiment of the present invention, the fixing device includes an endless belt-shaped fixing member, a nip formation member, a pressing member, a laminated heater, a heater support, a support member, and a biasing member. The fixing member rotates in a predetermined direction of rotation and is formed into a loop. The nip formation member is provided inside the loop formed by the fixing member. The pressing member is provided outside the loop formed by the fixing member to press the fixing member against the nip formation member to form a nip between the pressing member and the fixing member. The laminated heater contacts an inner circumferential surface of the fixing member to generate heat to be transmitted to the fixing member. The heater support is provided inside the loop formed by the fixing member, and includes a first surface that supports the laminated heater in a state in which the laminated heater is provided between the fixing member and the heater support and a second surface disposed back-to-back to the first surface. The heater support thermally expands in a first direction due to heat generated by the laminated heater. The support member is fixedly provided inside the loop formed by the fixing member and isolated from the second surface of the heater support. The biasing member is provided between the support member and the second surface of the heater support to apply bias to the heater support in a second direction opposite the first direction and in which the heater support presses the laminated heater against the inner circumferential surface of the fixing member.

This specification further describes an improved image forming apparatus. In one exemplary embodiment, the image forming apparatus includes the fixing device described above.

This specification further describes an improved method of heating a fixing member with a laminated heater pressed against the fixing member by a thermally expandable heater support. In one exemplary embodiment, the method includes the steps of receiving an output signal, detecting a first temperature of the fixing member, detecting a second temperature of an environment of the fixing member, performing a first comparison of the first temperature with a predetermined first reference temperature, performing a second comparison of the second temperature with a predetermined second reference temperature, and adjusting an upper limit of power supplied to the laminated heater based on the first comparison and the second comparison.

BRIEF DESCRIPTION OF THE DRAWINGS

A more complete appreciation of the invention and the many attendant advantages thereof will be readily obtained as the same becomes better understood by reference to the following detailed description when considered in connection with the accompanying drawings, wherein.

DETAILED DESCRIPTION OF THE INVENTION

Figure 1:
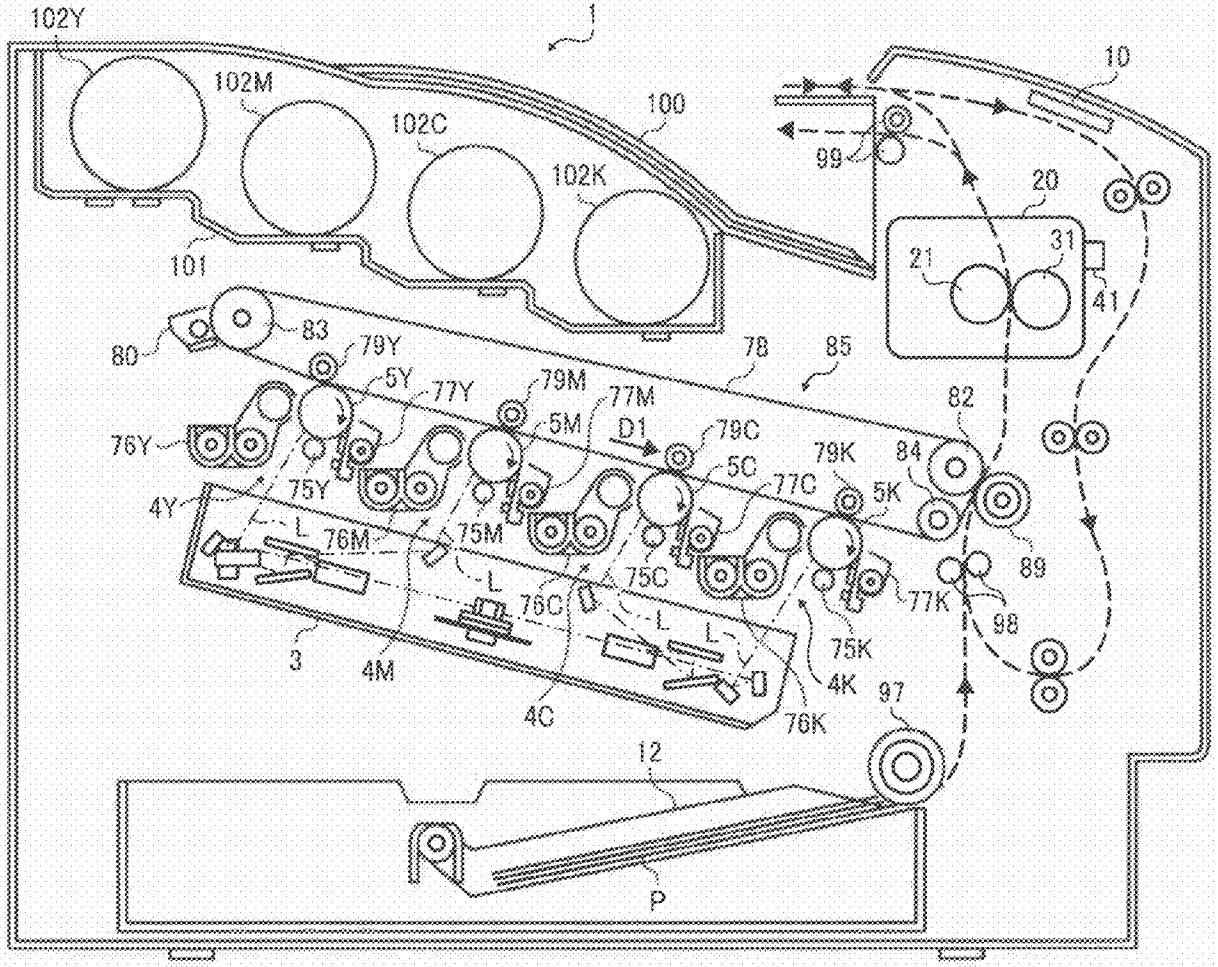
FIG. 1 is a schematic view of an image forming apparatus according to an exemplary embodiment of the present invention.

In describing exemplary embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner and achieve a similar result.

Referring now to the drawings, wherein like reference numerals designate identical or corresponding parts throughout the several views, in particular to FIG. 1, an image forming apparatus 1 according to an exemplary embodiment of the present invention is explained.

FIG. 1 is a schematic view of the image forming apparatus 1. As illustrated in FIG. 1, the image forming apparatus 1 may be a copier, a facsimile machine, a printer, a multifunction printer having at least one of copying, printing, scanning, plotter, and facsimile functions, or the like. According to this exemplary embodiment of the present invention, the image forming apparatus 1 is a tandem color printer for forming a color image on a recording medium.

As illustrated in FIG. 1, the image forming apparatus 1 includes image forming devices 4Y, 4M, 4C, and 4K disposed in a center portion of the image forming apparatus 1, a toner bottle holder 101 disposed above the image forming devices 4Y, 4M, 4C, and 4K in an upper portion of the image forming apparatus 1, an exposure device 3 disposed below the image forming devices 4Y, 4M, 4C, and 4K, a paper tray 12 disposed below the exposure device 3 in a lower portion of the image forming apparatus 1, an intermediate transfer unit 85 disposed above the image forming devices 4Y, 4M, 4C, and 4K, a second transfer roller 89 disposed opposite the intermediate transfer unit 85, a feed roller 97 and a registration roller pair 98 disposed between the paper tray 12 and the second transfer roller 89 in a recording medium conveyance direction, a fixing device 20 disposed above the second transfer roller 89, an ambient temperature detector 41 disposed near the fixing device 20, an output roller pair 99 disposed above the fixing device 20, a stack portion 100 disposed downstream from the output roller pair 99 in the recording medium conveyance direction on top of the image forming apparatus 1, and a controller 10 disposed in the upper portion of the image forming apparatus 1.

The toner bottle holder 101 includes four toner bottles 102Y, 102M, 102C, and 102K, which contain yellow, magenta, cyan, and black toners, respectively, and are detachably attached to the toner bottle holder 101 so that the toner bottles 102Y, 102M, 102C, and 102K are replaced with new ones, respectively.

The intermediate transfer unit 85 is disposed below the toner bottle holder 101, and includes an intermediate transfer belt 78 formed into a loop, four first transfer bias rollers 79Y, 79M, 79C, and 79K, a second transfer backup roller 82, a cleaning backup roller 83, and a tension roller 84, which are disposed inside the loop formed by the intermediate transfer belt 78, and an intermediate transfer cleaner 80 disposed outside the loop formed by the intermediate transfer belt 78. Specifically, the intermediate transfer belt 78 is supported by and stretched over three rollers, which are the second transfer backup roller 82, the cleaning backup roller 83, and the tension roller 84. A single roller, that is, the second transfer backup roller 82, drives and endlessly moves (e.g., rotates) the intermediate transfer belt 78 in a direction D1.

The image forming devices 4Y, 4M, 4C, and 4K are arranged opposite the intermediate transfer belt 78, and form yellow, magenta, cyan, and black toner images, respectively. The image forming devices 4Y, 4M, 4C, and 4K include photoconductive drums 5Y, 5M, 5C, and 5K which are surrounded by chargers 75Y, 75M, 75C, and 75K, development devices 76Y, 76M, 76C, and 76K, cleaners 77Y, 77M, 77C, and 77K, and dischargers, respectively. Image forming processes including a charging process, an exposure process, a development process, a primary transfer process, and a cleaning process are performed on the photoconductive drums 5Y, 5M, 5C, and 5K to form yellow, magenta, cyan, and black toner images on the photoconductive drums 5Y, 5M, 5C, and 5K, respectively, as a driving motor drives and rotates the photoconductive drums 5Y, 5M, 5C, and 5K clockwise in FIG. 1.

Specifically, in the charging process, the chargers 75Y, 75M, 75C, and 75K uniformly charge surfaces of the photoconductive drums 5Y, 5M, 5C, and 5K at charging positions at which the chargers 75Y, 75M, 75C, and 75K are disposed opposite the photoconductive drums 5Y, 5M, 5C, and 5K, respectively.

In the exposure process, the exposure device 3 emits laser beams L onto the charged surfaces of the respective photoconductive drums 5Y, 5M, 5C, and 5K according to image data sent from a client computer, for example. In other words, the exposure device 3 scans and exposes the charged surfaces of the photoconductive drums 5Y, 5M, 5C, and 5K at irradiation positions at which the exposure device 3 is disposed opposite the photoconductive drums 5Y, 5M, 5C, and 5K to irradiate the charged surfaces of the photoconductive drums 5Y, 5M, 5C, and 5K to form thereon electrostatic latent images corresponding to yellow, magenta, cyan, and black colors, respectively.

In the development process, the development devices 76Y, 76M, 76C, and 76K render the electrostatic latent images formed on the surfaces of the photoconductive drums 5Y, 5M, 5C, and 5K visible as yellow, magenta, cyan, and black toner images at development positions at which the development devices 76Y, 76M, 76C, and 76K are disposed opposite the photoconductive drums 5Y, 5M, 5C, and 5K, respectively.

In the primary transfer process, the first transfer bias rollers 79Y, 79M, 79C, and 79K transfer and superimpose the yellow, magenta, cyan, and black toner images formed on the photoconductive drums 5Y, 5M, 5C, and 5K onto the intermediate transfer belt 78 at first transfer positions at which the first transfer bias rollers 79Y, 79M, 79C, and 79K are disposed opposite the photoconductive drums 5Y, 5M, 5C, and 5K via the intermediate transfer belt 78, respectively. Thus, a color toner image is formed on the intermediate transfer belt 78. After the transfer of the yellow, magenta, cyan, and black toner images, a slight amount of residual toner, which has not been transferred onto the intermediate transfer belt 78, remains on the photoconductive drums 5Y, 5M, 5C, and 5K.

In the cleaning process, cleaning blades included in the cleaners 77Y, 77M, 77C, and 77K mechanically collect the residual toner from the photoconductive drums 5Y, 5M, 5C, and 5K at cleaning positions at which the cleaners 77Y, 77M, 77C, and 77K are disposed opposite the photoconductive drums 5Y, 5M, 5C, and 5K, respectively.

Finally, dischargers remove residual potential on the photoconductive drums 5Y, 5M, 5C, and 5K at discharging positions at which the dischargers are disposed opposite the photoconductive drums 5Y, 5M, 5C, and 5K, respectively, thus completing a single sequence of image forming processes performed on the photoconductive drums 5Y, 5M, 5C, and 5K.

The following describes the transfer processes, that is, the primary transfer process described above and a secondary transfer process, performed on the intermediate transfer belt 78. The four first transfer bias rollers 79Y, 79M, 79C, and 79K and the four photoconductive drums 5Y, 5M, 5C, and 5K sandwich the intermediate transfer belt 78 to form first transfer nips, respectively. The first transfer bias rollers 79Y, 79M, 79C, and 79K are applied with a transfer bias having a polarity opposite a polarity of toner forming the yellow, magenta, cyan, and black toner images on the photoconductive drums 5Y, 5M, 5C, and 5K, respectively. Accordingly, in the primary transfer process, the yellow, magenta, cyan, and black toner images formed on the photoconductive drums 5Y, 5M, 5C, and 5K, respectively, are primarily transferred and superimposed onto the intermediate transfer belt 78 rotating in the direction D1 successively at the first transfer nips formed between the photoconductive drums 5Y, 5M, 5C, and 5K and the intermediate transfer belt 78 as the intermediate transfer belt 78 moves through the first transfer nips. Thus, a color toner image is formed on the intermediate transfer belt 78.

The second transfer roller 89 is pressed against the second transfer backup roller 82 via the intermediate transfer belt 78 in such a manner that the second transfer roller 89 and the second transfer backup roller 82 sandwich the intermediate transfer belt 78 to form a second transfer nip between the second transfer roller 89 and the intermediate transfer belt 78. At the second transfer nip, the second transfer roller 89 secondarily transfers the color toner image formed on the intermediate transfer belt 78 onto a recording medium P sent from the paper tray 12 through the feed roller 97 and the registration roller pair 98 in the secondary transfer process. Thus, the desired color toner image is formed on the recording medium P. After the transfer of the color toner image, residual toner, which has not been transferred onto the recording medium P, remains on the intermediate transfer belt 78.

Thereafter, the intermediate transfer cleaner 80 collects the residual toner from the intermediate transfer belt 78 at a cleaning position at which the intermediate transfer cleaner 80 is disposed opposite the cleaning backup roller 83 via the intermediate transfer belt 78, thus completing a single sequence of transfer processes performed on the intermediate transfer belt 78.

The recording medium P is supplied to the second transfer nip from the paper tray 12 which loads a plurality of recording media P (e.g., transfer sheets). Specifically, the feed roller 97 rotates counterclockwise in FIG. 1 to feed an uppermost recording medium P of the plurality of recording media P loaded on the paper tray 12 toward a roller nip formed between two rollers of the registration roller pair 98.

The registration roller pair 98, which stops rotating temporarily, stops the uppermost recording medium P fed by the feed roller 97 and reaching the registration roller pair 98. For example, the roller nip of the registration roller pair 98 contacts and stops a leading edge of the recording medium P. The registration roller pair 98 resumes rotating to feed the recording medium P to the second transfer nip, formed between the second transfer roller 89 and the intermediate transfer belt 78, as the color toner image formed on the intermediate transfer belt 78 reaches the second transfer nip.

After the secondary transfer process described above, the recording medium P bearing the color toner image is sent to the fixing device 20 that includes a fixing sleeve 21 and a pressing roller 31. The fixing sleeve 21 and the pressing roller 31 apply heat and pressure to the recording medium P to fix the color toner image on the recording medium P.

Thereafter, the fixing device 20 feeds the recording medium P bearing the fixed color toner image toward the output roller pair 99. The output roller pair 99 discharges the recording medium P to an outside of the image forming apparatus 1, that is, the stack portion 100. Thus, the recording media P discharged by the output roller pair 99 are stacked on the stack portion 100 successively to complete a single sequence of image forming processes performed by the image forming apparatus 1.

Figure 2:
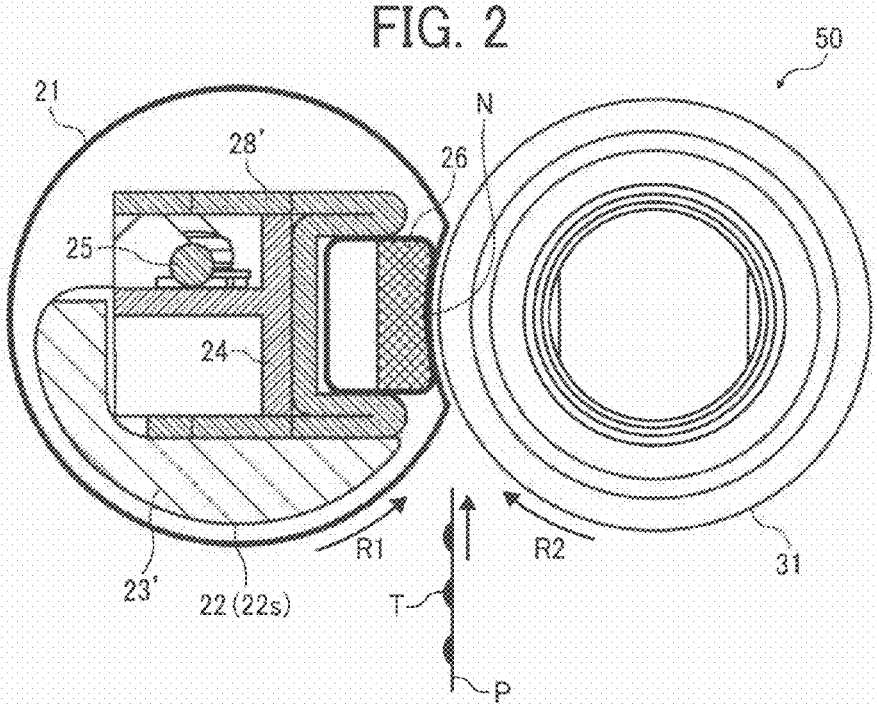
FIG. 2 is a vertical sectional view of a comparative fixing device.

Referring to FIG. 2, the following describes the structure of a comparative fixing device 50 that is comparative to the fixing device 20 depicted in FIG. 1.

FIG. 2 is a vertical sectional view of the comparative fixing device 50. As illustrated in FIG. 2, the comparative fixing device 50 includes the fixing sleeve 21 formed into a loop, a laminated heater 22, a heater support 23', a terminal stay 24, a power supply wiring 25, a nip formation member 26, and a core holder 28', which are disposed inside the loop formed by the fixing sleeve 21, and the pressing roller 31 provided outside the loop formed by the fixing sleeve 21.

As illustrated in FIG. 2, the fixing sleeve 21 is a rotatable endless belt serving as a fixing member or a rotary fixing member. The pressing roller 31 serves as a pressing member or a rotary pressing member that contacts an outer circumferential surface of the fixing sleeve 21. The nip formation member 26 faces an inner circumferential surface of the fixing sleeve 21, and is pressed against the pressing roller 31 via the fixing sleeve 21 to form a nip N between the pressing roller 31 and the fixing sleeve 21 through which a recording medium P bearing a toner image T passes. The laminated heater 22 also faces the inner circumferential surface of the fixing sleeve 21, and contacts or is disposed close to the inner circumferential surface of the fixing sleeve 21 to heat the fixing sleeve 21 directly or indirectly. The heater support 23' faces the inner circumferential surface of the fixing sleeve 21 to support the laminated heater 22 at a predetermined position in such a manner that the laminated heater 22 is disposed between the heater support 23' and the fixing sleeve 21. In FIG. 2, the laminated heater 22 is isolated from the inner circumferential surface of the fixing sleeve 21 to distinguish the laminated heater 22 from the fixing sleeve 21. However, practically, the laminated heater 22 contacts the inner circumferential surface of the fixing sleeve 21 to heat the fixing sleeve 21 directly.

Figure 3A:
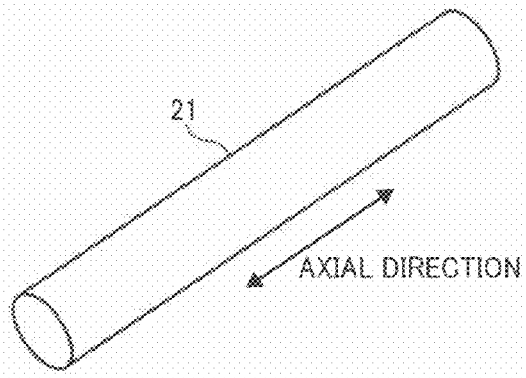
FIG. 3A is a perspective view of a fixing sleeve included in the comparative fixing device shown in FIG. 2.
Figure 3B:
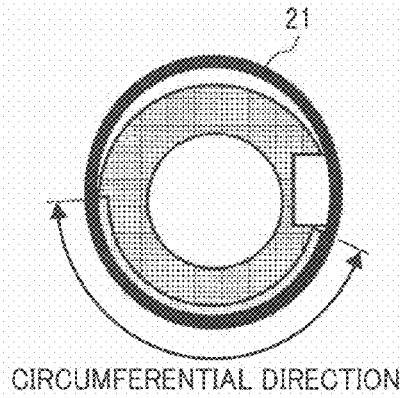
FIG. 3B is a vertical sectional view of the fixing sleeve shown in FIG. 3A.

Referring to FIGS. 3A and 3B, the following describes the fixing sleeve 21. FIG. 3A is a perspective view of the fixing sleeve 21. FIG. 3B is a vertical sectional view of the fixing sleeve 21. As illustrated in FIG. 3A, the fixing sleeve 21 is the flexible, pipe-shaped or cylindrical endless belt having a predetermined width in an axial direction of the fixing sleeve 21, which corresponds to a width of the recording medium P passing through the nip N formed between the fixing sleeve 21 and the pressing roller 31 depicted in FIG. 2. As illustrated in FIG. 3A, the axial direction of the pipe-shaped fixing sleeve 21 corresponds to a long axis, that is, a longitudinal direction, of the fixing sleeve 21. As illustrated in FIG. 3B, a circumferential direction of the pipe-shaped fixing sleeve 21 extends along a circumference of the fixing sleeve 21.

For example, the fixing sleeve 21 has an outer diameter of about 30 mm, and is constructed of a base layer made of a metal material and having a thickness in a range of from about 30 μm to about 50 μm, and at least a release layer provided on the base layer. The base layer of the fixing sleeve 21 is made of a conductive metal material such as iron, cobalt, nickel, an alloy of those, or the like. The release layer of the fixing sleeve 21 has a thickness in a range of from about 10 μm to about 50 μm, and is made of tetrafluoroethylene-perfluoroalkylvinylether copolymer (PFA), polytetrafluoroethylene (PTFE), polyimide, polyetherimide, polyether sulfide (PES), or the like. The release layer facilitates separation of toner of the toner image T on the recording medium P, which contacts the outer circumferential surface of the fixing sleeve 21 directly, from the fixing sleeve 21. Further, a lubricant such as grease or lubricating oil is applied on the inner circumferential surface of the fixing sleeve 21 to decrease frictional resistance between the nip formation member 26 and the fixing sleeve 21 sliding over the nip formation member 26.

On the other hand, the pressing roller 31 depicted in FIG. 2 has an outer diameter of about 30 mm, and is constructed of a metal core made of a metal material such as aluminum or copper; a heat-resistant elastic layer provided on the metal core and made of silicon rubber (e.g., solid rubber); and a release layer provided on the elastic layer. The elastic layer has a thickness of about 2 mm. The release layer is a PFA tube covering the elastic layer and has a thickness of about 50 μm. Optionally, a heat generator, such as a halogen heater, may be provided inside the metal core as needed.

The pressing roller 31 is connected to a pressure apply-release mechanism that applies pressure to the pressing roller 31 to cause the pressing roller 31 to contact the outer circumferential surface of the fixing sleeve 21 and releases the pressure to separate the pressing roller 31 from the fixing sleeve 21. Specifically, the pressure apply-release mechanism applies pressure to the pressing roller 31 to press the pressing roller 31 against the nip formation member 26 via the fixing sleeve 21 in a state in which the pressing roller 31 contacts the outer circumferential surface of the fixing sleeve 21 to form the nip N between the pressing roller 31 and the fixing sleeve 21. For example, a portion of the pressing roller 31 contacting the fixing sleeve 21 causes a concave portion of the fixing sleeve 21 at the nip N. Thus, the recording medium P passing through the nip N moves along the concave portion of the fixing sleeve 21. By contrast, the pressure apply-release mechanism releases the pressure applied to the pressing roller 31 to separate the pressing roller 31 from the outer circumferential surface of the fixing sleeve 21. Accordingly, the pressing roller 31 is not pressed against the nip formation member 26 via the fixing sleeve 21, and therefore the nip N is not formed between the pressing roller 31 and the fixing sleeve 21.

A driver drives and rotates the pressing roller 31, which presses the fixing sleeve 21 against the nip formation member 26, clockwise in FIG. 2 in a rotation direction R2. Accordingly, the fixing sleeve 21 rotates in accordance with rotation of the pressing roller 31 counterclockwise in FIG. 2 in a rotation direction R1.

A longitudinal direction of the nip formation member 26 is parallel to the axial direction of the fixing sleeve 21. At least a portion of the nip formation member 26 that is pressed against the pressing roller 31 via the fixing sleeve 21 is made of a heat-resistant elastic material such as fluorocarbon rubber. The core holder 28' supports and holds the nip formation member 26 at a predetermined position inside the loop formed by the fixing sleeve 21. Preferably, a portion of the nip formation member 26 which contacts the inner circumferential surface of the fixing sleeve 21 may be made of a slidable and durable material such as Teflon® sheet.

The core holder 28' is made of sheet metal, and has a predetermined width in a longitudinal direction thereof, corresponding to the width of the fixing sleeve 21 in the axial direction of the fixing sleeve 21. The core holder 28' is a rigid member having an H-shape in cross-section, and is disposed at substantially a center position inside the loop formed by the fixing sleeve 21.

The core holder 28' holds the respective components provided inside the loop formed by the fixing sleeve 21 at predetermined positions. For example, the H-shaped core holder 28' includes a first concave portion facing the pressing roller 31, which houses and holds the nip formation member 26. In other words, the core holder 28' is disposed opposite the pressing roller 31 via the nip formation member 26 to support the nip formation member 26 at a back face of the nip formation member 26 disposed back-to-back to a front face of the nip formation member 26 facing the nip N. Accordingly, even when the pressing roller 31 presses the fixing sleeve 21 against the nip formation member 26, the core holder 28' prevents substantial deformation of the nip formation member 26. In addition, the nip formation member 26 held by the core holder 28' protrudes from the core holder 28' slightly toward the pressing roller 31. Accordingly, the core holder 28' is isolated from the fixing sleeve 21 and does not contact the fixing sleeve 21 at the nip N.

The H-shaped core holder 28' further includes a second concave portion disposed back-to-back to the first concave portion, which houses and holds the terminal stay 24 and the power supply wiring 25. The terminal stay 24 has a predetermined width in a longitudinal direction thereof, corresponding to the width of the fixing sleeve 21 in the axial direction of the fixing sleeve 21, and is T-shaped in cross-section. The power supply wiring 25 extends on the terminal stay 24, and transmits power supplied from an outside of the comparative fixing device 50. A part of an outer circumferential surface of the core holder 28' holds the heater support 23' that supports the laminated heater 22. In FIG. 2, the core holder 28' holds the heater support 23' in a lower half region inside the loop formed by the fixing sleeve 21, that is, in a semicircular region provided upstream from the nip N in the rotation direction R1 of the fixing sleeve 21. The heater support 23' can be adhered to the core holder 28' to facilitate assembly. Alternatively, the heater support 23' may not be adhered to the core holder 28' to suppress heat transmission from the heater support 23' to the core holder 28'.

The heater support 23' supports the laminated heater 22 in such a manner that the laminated heater 22 contacts the inner circumferential surface of the fixing sleeve 21. Accordingly, the heater support 23' includes an arc-shaped outer circumferential surface having a predetermined circumferential length and disposed along the inner circumferential surface of the circular fixing sleeve 21 in cross-section.

Preferably, the heater support 23' has a heat resistance that resists heat generated by the laminated heater 22, a strength sufficient to support the laminated heater 22 without being deformed by the fixing sleeve 21 even when the rotating fixing sleeve 21 contacts the laminated heater 22, and sufficient heat insulation so that heat generated by the laminated heater 22 is not transmitted to the core holder 28' but is transmitted to the fixing sleeve 21. For example, the heater support 23' may be molded foam made of polyimide resin. Alternatively, a supplemental solid resin member may be provided inside the molded foam made of polyimide resin to improve rigidity.

Figure 4:
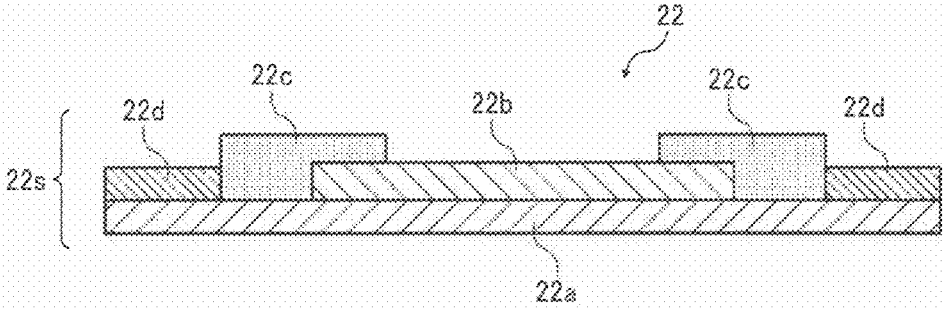
FIG. 4 is a horizontal sectional view of a laminated heater included in the comparative fixing device shown in FIG. 2.

Referring to FIG. 4, the following describes the laminated heater 22. FIG. 4 is a horizontal sectional view of the laminated heater 22. As illustrated in FIG. 4, the laminated heater 22 includes a heat generation sheet **22*s* constructed of a base layer 22*a* having insulation; a resistant heat generation layer 22*b* provided on the base layer 22*a* and including conductive particles dispersed in a heat-resistant resin; an electrode layer 22*c* provided on the base layer 22*a* to supply power to the resistant heat generation layer 22*b*; and an insulation layer 22*d* provided on the base layer 22*a*. The heat generation sheet 22*s* is flexible, and has a predetermined width in the axial direction of the fixing sleeve 21 depicted in FIG. 3A and a predetermined length in the circumferential direction of the fixing sleeve 21 depicted in FIG. 3B. The insulation layer 22*d* insulates one resistant heat generation layer 22*b* from the adjacent electrode layer 22*c* of a different power supply system, and insulates an edge of the heat generation sheet 22*s* from an outside of the heat generation sheet 22*s***.

The laminated heater 22 further includes a plurality of electrode terminal pairs provided at one edge of the heat generation sheet **22*s* and connected to the electrode layers 22*c* to transmit power supplied from the power supply wiring 25 to the electrode layers 22*c***.

The heat generation sheet **22*s* has a thickness in a range of from about 0.1 mm to about 1.0 mm, and has a flexibility sufficient to wrap around the heater support 23' depicted in FIG. 2 at least along the outer circumferential surface of the heater support 23'**.

The base layer **22*a* is a thin, elastic film made of a resin having a certain level of heat resistance, such as polyethylene terephthalate (PET) or polyimide resin. For example, the base layer 22*a*** may be a film made of polyimide resin to provide heat resistance, insulation, and a certain level of flexibility.

The resistant heat generation layer **22*b* is a thin, conductive film in which conductive particles, such as carbon particles and metal particles, are uniformly dispersed in a heat-resistant resin such as polyimide resin. When power is supplied to the resistant heat generation layer 22***b*, internal resistance of the resistant heat generation layer 22*b* generates Joule heat. The resistant heat generation layer 22*b* is manufactured by coating the base layer 22*a* with a coating compound in which conductive particles, such as carbon particles and metal particles, are dispersed in a precursor made of a heat-resistant resin such as polyimide resin.

Alternatively, the resistant heat generation layer 22*b* may be manufactured by providing a thin conductive layer made of carbon particles and/or metal particles on the base layer 22*a* and then providing a thin insulation film made of a heat-resistant resin such as polyimide resin on the thin conductive layer. Thus, the thin insulation film is laminated on the thin conductive layer to integrate the thin insulation film with the thin conductive layer.

The carbon particles used in the resistant heat generation layer 22*b* may be known carbon black powder or carbon nanoparticles made of at least one of carbon nanofiber, carbon nanotube, and carbon microcoil.

The metal particles used in the resistant heat generation layer 22*b* may be silver, aluminum, or nickel particles, and may be granular or filament-shaped.

The insulation layer 22*d* may be manufactured by coating the base layer 22*a* with an insulation material including a heat-resistant resin identical to that of the base layer 22*a*, such as polyimide resin.

The electrode layer 22*c* may be manufactured by coating the base layer 22*a* with a conductive ink or a conductive paste such as silver. Alternatively, metal foil or a metal mesh may be adhered to the base layer 22*a*.

The heat generation sheet 22*s* of the laminated heater 22 is a thin sheet having a small heat capacity, and is heated quickly. An amount of heat generated by the heat generation sheet 22*s* is arbitrarily set according to the volume resistivity of the resistant heat generation layer 22*b*. In other words, the amount of heat generated by the heat generation sheet 22*s* can be adjusted according to the material, shape, size, and dispersion of conductive particles of the resistant heat generation layer 22*b*. For example, the laminated heater 22 providing heat generation per unit area of 35 W/cm$^2$ outputs a total power of about 1,200 W with the heat generation sheet 22*s* having a width of about 20 cm in the axial direction of the fixing sleeve 21 and a length of about 2 cm in the circumferential direction of the fixing sleeve 21, for example.

If a metal filament, such as a stainless steel filament, is used as a laminated heater, the metal filament causes asperities to appear on a surface of the laminated heater. Consequently, when the inner circumferential surface of the fixing sleeve 21 slides over the laminated heater, the asperities of the laminated heater abrade the surface of the laminated heater easily. To address this problem, the heat generation sheet 22*s* has a smooth surface without asperities as described above, improving durability in particular against wear due to sliding of the inner circumferential surface of the fixing sleeve 21 over the laminated heater 22. Further, a surface of the resistant heat generation layer 22*b* of the heat generation sheet 22*s* may be coated with fluorocarbon resin to further improve durability.

In FIG. 2, the heat generation sheet 22*s* of the laminated heater 22 faces the inner circumferential surface of the fixing sleeve 21 in a region in the circumferential direction of the fixing sleeve 21 between a position on the fixing sleeve 21 opposite the nip N via an axis of the fixing sleeve 21 and a position immediately upstream from the nip N in the rotation direction R1 of the fixing sleeve 21. However, the region in which the heat generation sheet 22*s* is provided is not limited to the region described above.

Referring to FIGS. 1 and 2, the following describes operation of the comparative fixing device 50 having the above-described structure.

When the image forming apparatus 1 receives an output signal, for example, when the image forming apparatus 1 receives a print request specified by a user by using a control panel or a print request sent from an external device, such as a client computer, the pressure apply-release mechanism applies pressure to the pressing roller 31 to cause the pressing roller 31 to press the fixing sleeve 21 against the nip formation member 26 to form the nip N between the pressing roller 31 and the fixing sleeve 21.

Thereafter, a driver drives and rotates the pressing roller 31 clockwise in FIG. 2 in the rotation direction R2. Accordingly, the fixing sleeve 21 rotates counterclockwise in FIG. 2 in the rotation direction R1 in accordance with rotation of the pressing roller 31. The rotating pressing roller 31 pulls and stretches an upstream portion of the fixing sleeve 21 upstream from the nip N in the rotation direction R1 of the fixing sleeve 21 toward the nip N. Accordingly, the fixing sleeve 21 presses the heat generation sheet 22*s* of the laminated heater 22 against the heater support 23'. In other words, the heat generation sheet 22*s* contacts the inner circumferential surface of the fixing sleeve 21 in a state in which the fixing sleeve 21 slides over the heat generation sheet 22*s*.

Simultaneously, an external power source or an internal capacitor supplies power to the laminated heater 22 via the power supply wiring 25 to cause the heat generation sheet 22*s* to generate heat. The heat generated by the heat generation sheet 22*s* is transmitted effectively to the fixing sleeve 21 contacting the heat generation sheet 22*s* throughout the entire width of the fixing sleeve 21 in the axial direction of the fixing sleeve 21, so that the fixing sleeve 21 is heated quickly. Alternatively, heating of the fixing sleeve 21 by the laminated heater 22 may not start simultaneously with driving of the pressing roller 31 by the driver. In other words, the laminated heater 22 may start heating the fixing sleeve 21 at a time different from a time at which the driver starts driving the pressing roller 31.

A temperature detector is provided at a position upstream from the nip N in the rotation direction R1 of the fixing sleeve 21. For example, the temperature detector is disposed outside the loop formed by the fixing sleeve 21 to face the outer circumferential surface of the fixing sleeve 21 with or without contacting the fixing sleeve 21. Alternatively, the temperature detector may be disposed inside the loop formed by the fixing sleeve 21. The temperature detector detects the temperature of the fixing sleeve 21 so that heat generation of the laminated heater 22 is controlled based on a detection result provided by the temperature detector to heat the nip N up to a predetermined fixing temperature. When the nip N is heated to the predetermined fixing temperature, the fixing temperature is maintained, and a recording medium P is conveyed to the nip N.

With the above-described configuration of the comparative fixing device 50, the fixing sleeve 21 and the laminated heater 22 having a small heat capacity shorten a warm-up time and a first print time while at the same time saving energy. Further, since the heat generation sheet 22*s* of the laminated heater 22 is made of resin, even when rotation and vibration of the pressing roller 31 apply mechanical stress to the heat generation sheet 22*s* repeatedly, and therefore bend the heat generation sheet 22*s* repeatedly, the heat generation sheet 22*s* is not damaged due to fatigue failure and concomitant breakage, providing long-duration operation.

However, in the comparative fixing device 50, temperature fluctuation may arise on the fixing sleeve 21 in the axial direction of the fixing sleeve 21, destabilizing the fixing process. The temperature fluctuation on the fixing sleeve 21 is caused by non-uniform contact of the fixing sleeve 21 with the heat generation sheet 22*s* in the axial direction of the fixing sleeve 21 and resultant variation in heat transmission efficiency for transmitting heat from the heat generation sheet 22*s* to the fixing sleeve 21.

To address this problem, the heat generation sheet 22*s* may be pressed against the fixing sleeve 21 to cause the heat generation sheet 22*s* to contact the inner circumferential surface of the fixing sleeve 21 uniformly in the axial direction of the fixing sleeve 21. However, when the heat generation sheet 22*s* is pressed against the fixing sleeve 21 with substantial pressure to decrease thermal resistance between the heat generation sheet 22*s* and the fixing sleeve 21 contacting the heat generation sheet 22*s*, frictional resistance between the heat generation sheet 22*s* and the fixing sleeve 21 sliding over the heat generation sheet 22*s* increases, disturbing rotation of the fixing sleeve 21. Moreover, when a lubricant (e.g., grease) is applied to the inner circumferential surface of the fixing sleeve 21 to reduce the frictional resistance between the heat generation sheet 22*s* and the fixing sleeve 21, such lubricant may increase the frictional resistance between the heat generation sheet 22*s* and the fixing sleeve 21. Specifically, immediately after the comparative fixing device 50 is powered on, the lubricant is not warmed yet and therefore has a substantial viscosity that increases the frictional resistance between the heat generation sheet 22*s* and the fixing sleeve 21 sliding over the heat generation sheet 22*s*.

Figure 5A:
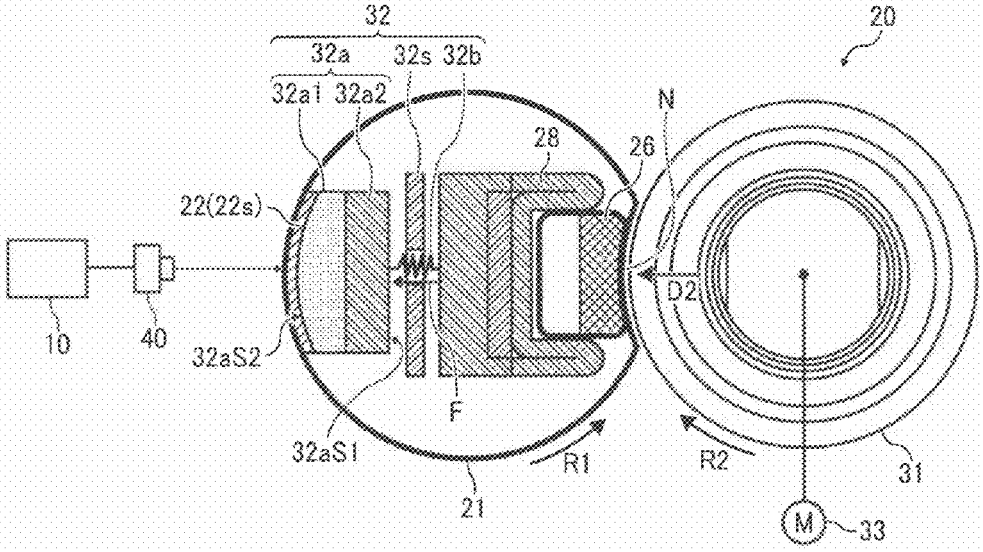
FIG. 5A is a vertical sectional view of a fixing device included in the image forming apparatus shown in FIG. 1.
Figure 5B:
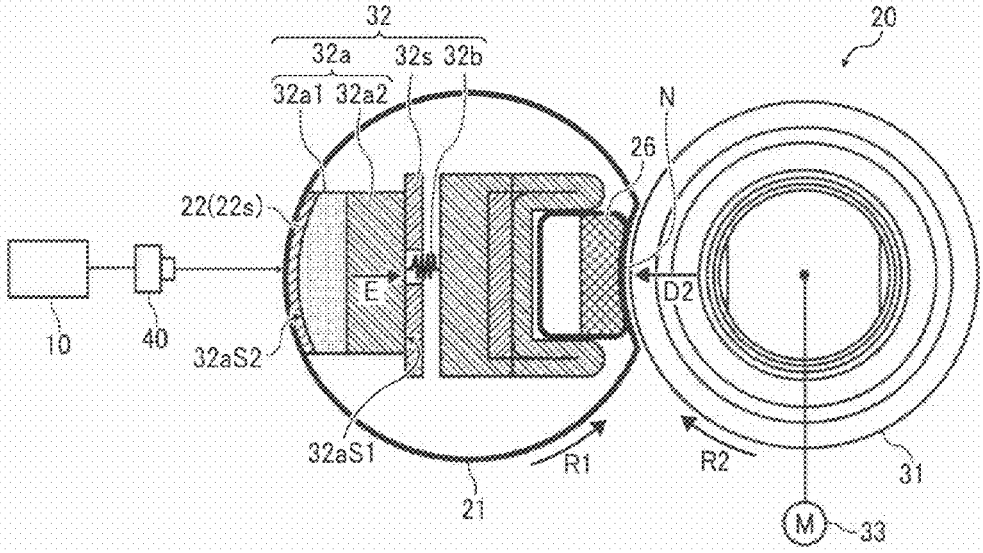
FIG. 5B is a vertical sectional view of the fixing device shown in FIG. 5A when a heater support included in the fixing device is thermally expanded.

To address this problem, when the lubricant is not warmed, the heat generation sheet 22*s* can be pressed against the fixing sleeve 21 with reduced pressure and the pressure can be increased as the temperature of the lubricant increases, achieved with the simple structure that presses the heat generation sheet 22*s* against the fixing sleeve 21 as illustrated in FIGS. 5A and 5B.

Referring to FIGS. 5A and 5B, the following describes the fixing device 20 according to a first illustrative embodiment of the present invention, which has the simple structure capable of adjusting the pressure with which the heat generation sheet 22*s* is pressed against the fixing sleeve 21. FIG. 5A is a vertical sectional view of the fixing device 20 during warm-up of the fixing device 20, when it has not been warmed up yet from a room temperature. FIG. 5B is a vertical sectional view of the fixing device 20 after it has been warmed up.

As illustrated in FIG. 5A, the fixing device 20 includes the fixing sleeve 21 formed into a loop, the laminated heater 22, a heater pressing mechanism 32, the nip formation member 26, and a core holder 28, which are disposed inside the loop formed by the fixing sleeve 21, and the pressing roller 31, a driver 33 (e.g., a motor), the controller 10 (e.g., a central processing unit (CPU) provided with a random-access memory (RAM) and a read-only memory (ROM)), and a temperature detector 40, which are disposed outside the loop formed by the fixing sleeve 21.

As illustrated in FIG. 5A, the fixing sleeve 21 is a rotatable endless belt serving as a fixing member or a rotary fixing member, with a lubricant (e.g., grease or lubricating oil) applied to the inner circumferential surface thereof. The pressing roller 31 serves as a pressing member or a rotary pressing member that faces the outer circumferential surface of the fixing sleeve 21 and applies pressure to the fixing sleeve 21 to press the fixing sleeve 21 against the nip formation member 26. The nip formation member 26 faces the inner circumferential surface of the fixing sleeve 21, and is pressed against the pressing roller 31 via the fixing sleeve 21 by the pressure applied by the pressing roller 31 to form the nip N between the pressing roller 31 and the fixing sleeve 21 through which the recording medium P passes. The laminated heater 22 also faces the inner circumferential surface of the fixing sleeve 21, and includes the heat generation sheet 22*s* that contacts the inner circumferential surface of the fixing sleeve 21 to heat the fixing sleeve 21. The heater pressing mechanism 32 includes a heater support 32*a* that faces the inner circumferential surface of the fixing sleeve 21 to support the laminated heater 22 in such a manner that the laminated heater 22 is disposed between the heater support 32*a* and the fixing sleeve 21. The core holder 28, serving as a support member, is fixedly provided inside the loop formed by the fixing sleeve 21 in such a manner that the core holder 28 is isolated from an inner surface 32*a*S1 of the heater support 32*a* disposed back-to-back to an outer surface 32*a*S2 of the heater support 32*a*, which contacts and supports the heat generation sheet 22*s* of the laminated heater 22. The heater pressing mechanism 32 further includes biasing members 32*b* (only one of which is shown in FIGS. 5A and 5B) disposed between the core holder 28 and the inner surface 32*a*S1 of the heater support 32*a* to bias the heater support 32*a* against the fixing sleeve 21.

The heater pressing mechanism 32 further includes a plate-shaped stopper 32*s* disposed between the core holder 28 and the inner surface 32*a*S1 of the heater support 32*a*.

Thus, the heater pressing mechanism 32 is constructed of the heater support 32*a*, the biasing members 32*b*, and the stopper 32*s*.

The temperature detector 40 is disposed opposite the laminated heater 22 via the fixing sleeve 21 and serves as a fixing member temperature detector that detects the temperature of the fixing sleeve 21 at a position at which the fixing sleeve 21 contacts the laminated heater 22.

It is to be noted that the fixing sleeve 21, the terminal stay 24, the power supply wiring 25, the nip formation member 26, and the pressing roller 31 of the fixing device 20 are equivalent to those of the comparative fixing device 50 depicted in FIG. 2. However, the fixing device 20 includes the heater pressing mechanism 32 that is not installed in the comparative fixing device 50 and is explained below with reference to FIGS. 6 and 7.

Figure 6:
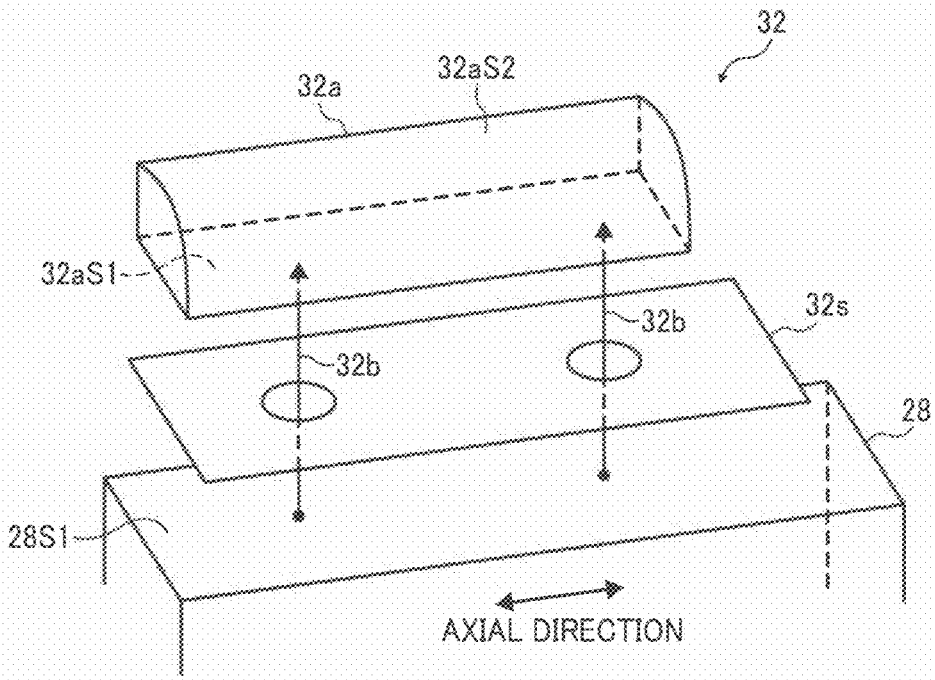
FIG. 6 is a perspective view of a heater pressing mechanism and a core holder included in the fixing device shown in FIG. 5A.
Figure 7:
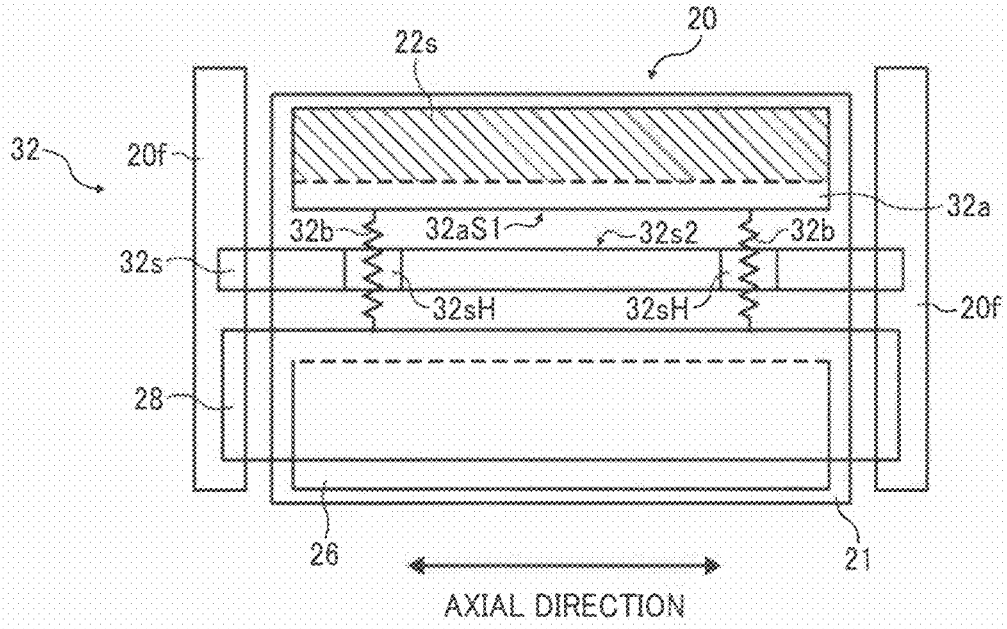
FIG. 7 is a plan view of the heater pressing mechanism and the core holder shown in FIG. 6.

Referring to FIGS. 6 and 7, the following describes the heater pressing mechanism 32. FIG. 6 is a perspective view of the heater pressing mechanism 32. FIG. 7 is a plan view of the heater pressing mechanism 32. As illustrated in FIG. 5A, the heater support 32*a* supports the heat generation sheet 22*s* of the laminated heater 22 in such a manner that the heat generation sheet 22*s* contacts the inner circumferential surface of the fixing sleeve 21. Accordingly, the outer surface 32*a*S2 of the heater support 32*a* which contacts and supports the heat generation sheet 22*s* is arc-shaped in cross-section with a predetermined length in the circumferential direction of the fixing sleeve 21 to correspond to the circular inner circumferential surface of the fixing sleeve 21 in cross-section.

Preferably, the heater support 32*a* has a heat resistance that resists heat generated by the heat generation sheet 22*s*, a strength sufficient to support the heat generation sheet 22*s* without being deformed by the fixing sleeve 21 even when the rotating fixing sleeve 21 contacts the heat generation sheet 22*s*, and sufficient heat insulation so that heat generated by the heat generation sheet 22*s* is not transmitted to the core holder 28 but is transmitted to the fixing sleeve 21. The heater support 32*a* may be molded foam made of a heat-resistant resin such as polyimide resin.

Alternatively, the heater support 32*a* may include a heat-resistant resin foam member 32*a*1 and a heat-resistant rubber member 32*a*2 having a thermal expansion coefficient greater than that of the heat-resistant resin foam member 32*a*1. When the heat-resistant rubber member 32*a*2 with a greater linear expansion coefficient expands, it presses the heat generation sheet 22*s* against the fixing sleeve 21 with a greater force.

Preferably, the heat-resistant rubber member 32*a*2 made of silicon rubber is coupled with the heat-resistant resin foam member 32*a*1 made of polyimide. For example, the heat-resistant rubber member 32*a*2 made of silicon rubber has a linear expansion coefficient in a range of from about $2.5\times10^{-4}$ to about $4.0\times10^{-4}$ per Celsius. Accordingly, the heat-resistant rubber member 32*a*2 having a thickness of about 10 mm has maximum thermal expansion of about 0.4 mm for a temperature increase of about 100 degrees centigrade.

As illustrated in FIG. 6, in contrast with the arc-shaped outer surface 32*a*S2 of the heater support 32*a*, the inner surface 32*a*S1 of the heater support 32*a* disposed back-to-back to the outer surface 32*a*S2 is a flat surface substantially parallel to an inner surface 28S1 of the core holder 28 which faces the inner surface 32*a*S1 of the heater support 32*a*.

Each of the biasing members 32*b* is a spring (e.g., a coil spring or a plate spring) disposed between the core holder 28 and the heater support 32*a* in such a manner that the biasing member 32*b* is supported by the core holder 28 and contacted by the heater support 32*a*. At least two biasing members 32*b* may be provided on the core holder 28 to press the heater support 32*a* against the fixing sleeve 21 at two positions, that is, lateral ends of the heater support 32*a* in a longitudinal direction of the heater support 32*a* parallel to the axial direction of the fixing sleeve 21.

As illustrated in FIG. 7, lateral ends of the stopper 32*s* in the axial direction of the fixing sleeve 21 are mounted on side plates 20*f* of the fixing device 20 in such a manner that the stopper 32*s* is disposed between the heater support 32*a* and the core holder 28, with an outer surface 32*s*2 of the stopper 32*s* parallel to the planar inner surface 32*a*S1 of the heater support 32*a*. The core holder 28 is also mounted on the side plates 20*f* of the fixing device 20. The biasing members 32*b* are provided in through-holes 32*s*H, which penetrate the stopper 32*s*, without contacting interior walls of the through-holes 32*s*H, respectively.

Referring to FIGS. 5A and 5B, the following describes the relative positions of the heater support 32*a* and the stopper 32*s*. As illustrated in FIG. 5A, when the fixing device 20 is not yet warmed up under a room temperature of about 20 degrees centigrade, the inner surface 32*a*S1 of the heater support 32*a* disposed back-to-back to the outer surface 32*a*S2 thereof that contacts the heat generation sheet 22*s* is isolated from the stopper 32*s*. By contrast, when the heater support 32*a* is thermally expanded as the fixing device 20 is warmed up, the inner surface 32*a*S1 of the heater support 32*a* contacts the stopper 32*s* as illustrated in FIG. 5B.

For example, when the fixing device 20 is not yet warmed up, a gap in a range of from about 0.1 mm to about 0.5 mm is present between the stopper 32*s* and the inner surface 32*a*S1 of the heater support 32*a*.

Referring to FIGS. 5A, 5B, 8, and 9, the following describes change in surface pressure applied to the fixing sleeve 21 by the laminated heater 22 that contacts the fixing sleeve 21 and rotational torque of the driver 33 that drives and rotates the pressing roller 31 that rotates the fixing sleeve 21 in the rotation direction R1 when the fixing device 20 is warmed up with the relative positions of the heater support 32*a* and the stopper 32*s* described above. In the fixing device 20, the driver 33 drives and rotates the pressing roller 31 and the fixing sleeve 21 rotates in accordance with rotation of the pressing roller 31.

Figure 8:
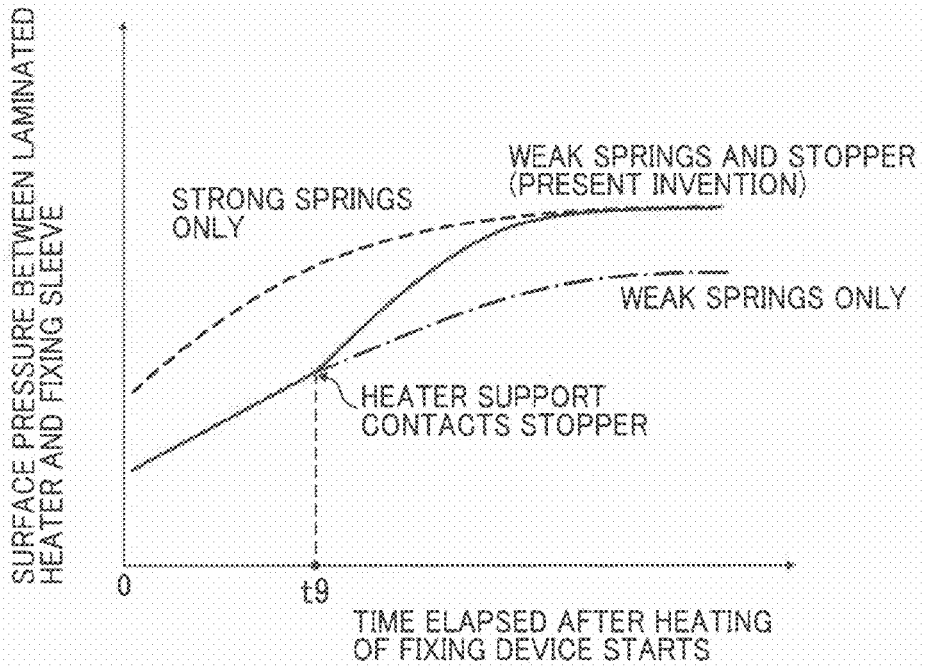
FIG. 8 is a graph illustrating change of pressure with which a laminated heater presses against a fixing sleeve in the fixing device shown in FIG. 5A during warm-up of the fixing device.

When the fixing device 20 is not yet warmed up immediately after the fixing device 20 is powered on, the heater support 32*a* is not thermally expanded and therefore it is isolated from the stopper 32*s* as illustrated in FIG. 5A. Specifically, the heater support 32*a* is pressed against the heat generation sheet 22*s* only by a small bias applied by the biasing members 32*b*. In other words, the heat generation sheet 22*s* contacts the inner circumferential surface of the fixing sleeve 21 with a relatively small surface pressure at the start of heating of the fixing device 20 as illustrated in FIG. 8.

Also, the lubricant applied to the inner circumferential surface of the fixing sleeve 21 is not yet warmed up and therefore has a high viscosity that increases frictional resistance between the heat generation sheet 22*s* and the fixing sleeve 21 sliding over the fixing sleeve 21, increasing the rotational torque of the driver 33 that drives and rotates the pressing roller 31. To address this problem, according to this exemplary embodiment, weak springs with a relatively smaller bias, which have a spring constant in a range of from about 0.15 kgf/mm to about 0.20 kgf/mm, are used as the biasing members 32*b* to prohibit the rotational torque of the driver 33 from exceeding an allowable limit that allows rotation of the fixing sleeve 21 or to maintain the rotational torque of the driver 33 within an allowable range that allows rotation of the fixing sleeve 21 when heating of the fixing device 20 is started as illustrated in FIG. 9.

On the other hand, strong springs with a relatively greater bias, which have a spring constant in a range of from about 2.00 kgf/mm to about 2.50 kgf/mm, may be required to press the heat generation sheet 22*s* against the fixing sleeve 21 with a sufficient surface pressure using only the biasing members 32*b* even after the fixing device 20 is warmed up. However, when the fixing device 20 is not yet warmed up, such strong springs cause the rotational torque of the driver 33 to exceed the allowable limit when heating of the fixing device 20 is started as illustrated by a broken line L1 indicated as "strong springs only" in FIG. 9, and therefore are not appropriate.

Thereafter, when power supply to the heat generation sheet 22*s* is started, heat generated by the heat generation sheet 22*s* is transmitted to the fixing sleeve 21 that contacts the heat generation sheet 22*s*. Simultaneously, heat is also transmitted to the heater support 32*a* to start thermal expansion of the heater support 32*a*. The outer surface 32*a*S2 of the heater support 32*a* presses against the fixing sleeve 21 stretched with a predetermined tension in such a manner that the outer surface 32*a*S2 of the heater support 32*a* is supported by the fixing sleeve 21. Accordingly, the heater support 32*a* thermally expands in a direction E (depicted in FIG. 5B) in which the heater support 32*a* resists the bias applied by the biasing members 32*b* in a direction F (depicted in FIG. 5A) to compress the biasing members 32*b*. As the biasing members 32*b* are compressed by the heater support 32*a*, the heat generation sheet 22*s* contacted by the heater support 32*a* presses against the inner circumferential surface of the fixing sleeve 21 with a surface pressure that gradually increases until a time t9 shown in FIG. 8.

Figure 9:
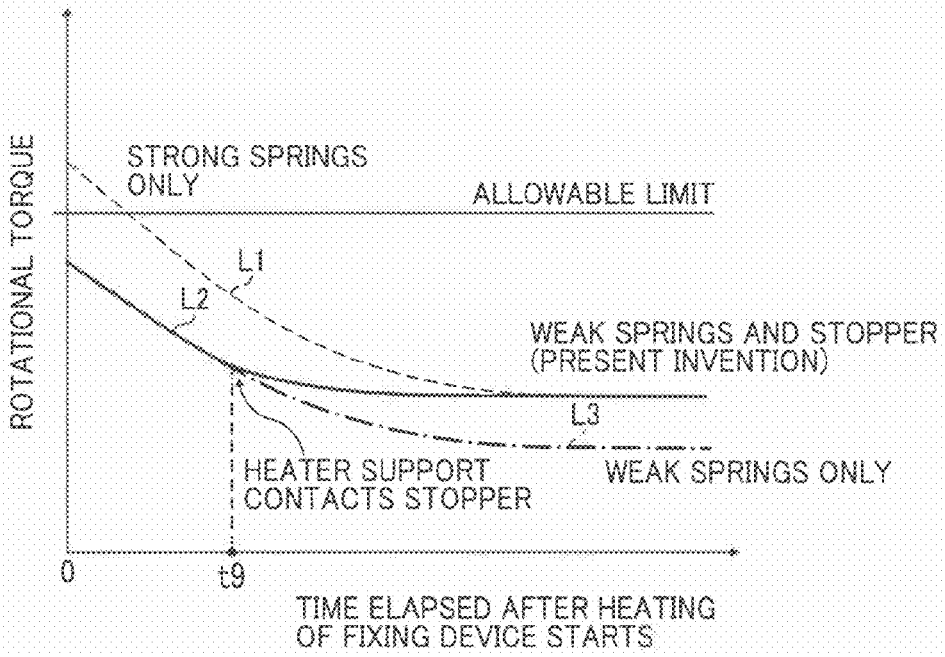
FIG. 9 is a graph illustrating change of rotational torque of a driver of the fixing device shown in FIG. 5A during warm-up of the fixing device.

By contrast, the rotational torque of the driver 33 gradually decreases until the time t9 shown in FIG. 9 as the surface pressure between the heat generation sheet 22*s* and the inner circumferential surface of the fixing sleeve 21 increases. Specifically, although the increased surface pressure between the heat generation sheet 22*s* and the fixing sleeve 21 increases frictional resistance between the heat generation sheet 22*s* and the fixing sleeve 21 sliding over the heat generation sheet 22*s*, the lubricant applied between the heat generation sheet 22*s* and the fixing sleeve 21 is also heated as the heat generation sheet 22*s* heats the fixing sleeve 21, and thus the lubricant has a reduced viscosity. In other words, the rotational torque of the driver 33 of the fixing device 20 according to this exemplary embodiment that has the biasing members 32*b*, that is, the weak springs, and the stopper 32*s* changes up to the time t9 as indicated by a solid line L2 in FIG. 9, which is equivalent to an alternate broken line L3 drawn by the configuration without the stopper 32*s* in which only weak springs, that is, the biasing members 32*b* with a small bias, press the heat generation sheet 22*s* against the fixing sleeve 21.

As the heater support 32*a* thermally expands further, it contacts the stopper 32*s* as illustrated in FIG. 5B. Since the stopper 32*s* is mounted on the side plates 20*f* of the fixing device 20 (depicted in FIG. 7), the heater support 32*a* cannot thermally expand any more in the direction E in which the heater support 32*a* resists the bias applied by the biasing members 32*b* in the direction F. Accordingly, the thermal expansion of the heater support 32*a* thereafter increases the surface pressure applied to the fixing sleeve 21 by the heat generation sheet 22*s* after the time t9 shown in FIG. 8. In other words, when the fixing sleeve 21 and the heater support 32*a* are heated to a predetermined temperature by heat generated by the heat generation sheet 22*s*, the heat generation sheet 22*s* contacts the inner circumferential surface of the fixing sleeve 21 with a greater surface pressure than a surface pressure caused by the biasing members 32*b*. Finally, when the temperature of the heater support 32*a* is maximized, the surface pressure with which the heat generation sheet 22*s* contacts the inner circumferential surface of the fixing sleeve 21 is also maximized. As a result, the heat generation sheet 22*s* contacts the fixing sleeve 21 with the surface pressure equivalent to that obtained with the configuration in which only the strong springs press the heat generation sheet 22*s* against the fixing sleeve 21.

After the heater support 32*a* contacts the stopper 32*s*, the surface pressure with which the heat generation sheet 22*s* contacts the inner circumferential surface of the fixing sleeve 21 increases sharply, slowing down decrease of the rotational torque of the driver 33. However, the lubricant applied on the inner circumferential surface of the fixing sleeve 21 is sufficiently heated to have a reduced viscosity, suppressing the overall rotational torque of the fixing device 20 to a lower level. Thus, the fixing sleeve 21 can be rotated with the lower rotational torque of the driver 33 after the time t9 shown in FIG. 9.

Preferably, the heat generation sheet 22*s* is adhered to the heater support 32*a* with an adhesive along an outer circumferential surface of the heater support 32*a* to prevent the heat generation sheet 22*s* from shifting from a proper position on the heater support 32*a*.

However, if the entire heat generation sheet 22*s* is adhered to the heater support 32*a*, heat is transmitted from the entire heat generation sheet 22*s* to the heater support 32*a*, decreasing heat transmission efficiency of the heat generation sheet 22*s* for transmitting heat from the heat generation sheet 22*s* to the fixing sleeve 21. To address this problem, it is preferable that the heat generation sheet 22*s* is adhered to the heater support 32*a* only at lateral end portions of the heat generation sheet 22*s* in the axial direction of the fixing sleeve 21 corresponding to non-conveyance regions on the fixing sleeve 21 over which the recording medium P is not conveyed, but not at a center portion of the heat generation sheet 22*s* in the axial direction of the fixing sleeve 21 corresponding to a conveyance region on the fixing sleeve 21 over which the recording medium P is conveyed. Accordingly, the heat generation sheet 22*s* does not deviate from the proper position on the heater support 32*a*, and at the same time the center portion of the heat generation sheet 22*s* in the axial direction of the fixing sleeve 21 corresponding to the conveyance region on the fixing sleeve 21 over which the maximum recording medium P available in the fixing device 20 is conveyed is not adhered to the heater support 32*a* and therefore is levitated from the heater support 32*a*. Consequently, heat is not transmitted from the center portion of the heat generation sheet 22*s* to the heater support 32*a*. In other words, heat generated in the center portion of the heat generation sheet 22*s* can be used to heat the fixing sleeve 21 effectively.

The heat generation sheet 22*s* may be adhered to the heater support 32*a* either with a liquid adhesive for coating or a tape adhesive (e.g., a double-faced adhesive tape), which provides adhesion on both sides thereof and is made of a heat-resistant acryl or silicon material. Accordingly, the laminated heater 22 (e.g., the heat generation sheet 22*s*) is adhered to the heater support 32*a* easily. Further, if the laminated heater 22 malfunctions, it can be replaced easily by peeling off the double-faced adhesive tape, facilitating maintenance.

It is to be noted that, if the heat generation sheet 22*s* and the heater support 32*a* merely sandwich the double-faced adhesive tape, the lateral end portions of the heat generation sheet 22*s* in the axial direction of the fixing sleeve 21, which are adhered to the heater support 32*a*, are lifted by a thickness of the double-faced adhesive tape. Accordingly, the center portion of the heat generation sheet 22*s* in the axial direction of the fixing sleeve 21, which is not adhered to the heater support 32*a*, does not contact or is not disposed close to the fixing sleeve 21 uniformly, decreasing heating efficiency for heating the fixing sleeve 21 and varying temperature distribution of the fixing sleeve 21 in the axial direction thereof.

Figure 10:
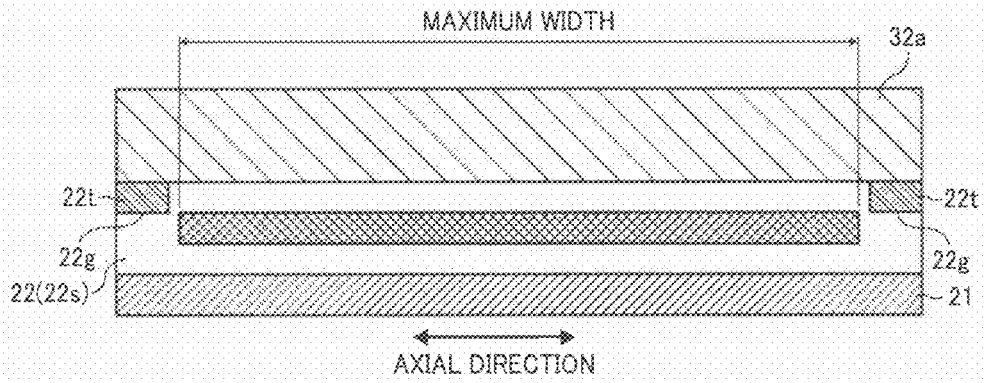
FIG. 10 is a horizontal sectional view of a laminated heater, a fixing sleeve, and a heater support included in the fixing device shown in FIG. 5A illustrating edge grooves included in the laminated heater.

To address this problem, the lateral end portions of the heat generation sheet 22*s* in the axial direction of the fixing sleeve 21, which are adhered to the heater support 32*a* with the double-faced adhesive tape, can have a thickness decreased by the thickness of the double-faced adhesive tape as illustrated in FIG. 10. FIG. 10 is a horizontal sectional view of the heater support 32*a*, the laminated heater 22, and the fixing sleeve 21. As illustrated in FIG. 10, the laminated heater 22 further includes edge grooves 22*g* and double-faced adhesive tapes 22*t*.

The edge grooves 22*g* are provided at lateral edges, which correspond to the non-conveyance regions on the fixing sleeve 21 over which the recording medium P is not conveyed, of the heat generation sheet 22*s* in the axial direction of the fixing sleeve 21, respectively, on a surface of the base layer 22*a* (depicted in FIG. 4) of the heat generation sheet 22*s* that faces the heater support 32*a*, and extend in the circumferential direction of the fixing sleeve 21. Each of the edge grooves 22*g* has a depth equivalent to the thickness (e.g., about 0.1 mm) of the double-faced adhesive tape 22*t*. The double-faced adhesive tapes 22*t* are adhered to the edge grooves 22*g* of the heat generation sheet 22*s*, respectively, and then adhered to the heater support 32*a*. In other words, the heat generation sheet 22*s* is adhered to the heater support 32*a* at predetermined positions on the heater support 32*a* via the double-faced adhesive tapes 22*t*. Accordingly, when the heat generation sheet 22*s* is adhered to the heater support 32*a*, a surface of the heat generation sheet 22*s* which faces the fixing sleeve 21 is planar in the axial direction of the fixing sleeve 21. Consequently, the heat generation sheet 22*s* uniformly contacts or is disposed close to the fixing sleeve 21 at the center portion of the heat generation sheet 22*s* corresponding to the conveyance region on the fixing sleeve 21 over which the recording medium P is conveyed, providing improved heating efficiency for heating the fixing sleeve 21 and uniform temperature distribution of the fixing sleeve 21 in the axial direction thereof.

Figure 11:
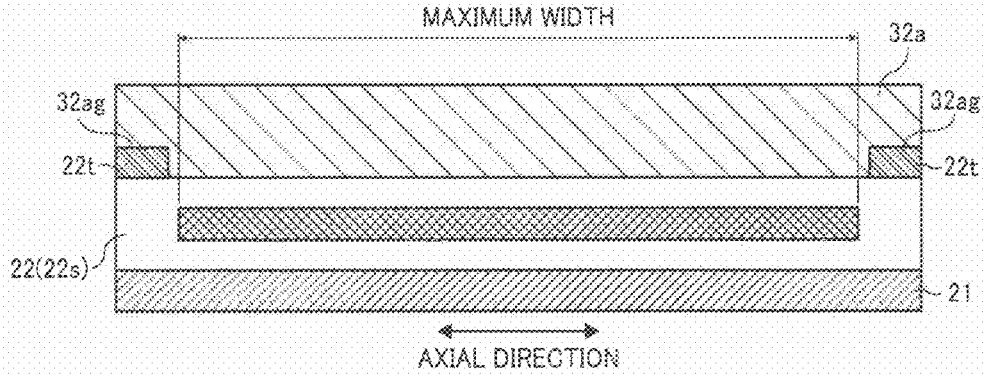
FIG. 11 is a horizontal sectional view of a laminated heater, a fixing sleeve, and a heater support included in the fixing device shown in FIG. 5A illustrating edge grooves included in the heater support.

Alternatively, edge grooves may be provided in the heater support 32*a* instead of in the heat generation sheet 22*s* as illustrated in FIG. 11. FIG. 11 is a horizontal sectional view of the heater support 32*a*, the laminated heater 22, and the fixing sleeve 21. As illustrated in FIG. 11, the heater support 32*a* includes edge grooves 32*ag*.

The edge grooves 32*ag* are provided at lateral edges of the heater support 32*a* in the axial direction of the fixing sleeve 21, which correspond to the non-conveyance regions on the fixing sleeve 21 over which the recording medium P is not conveyed, on a surface of the heater support 32*a* which faces the heat generation sheet 22*s*, and extend in the circumferential direction of the fixing sleeve 21. Each of the edge grooves 32*ag* has a depth equivalent to the thickness of the double-faced adhesive tape 22*t*. The double-faced adhesive tapes 22*t* are adhered to the edge grooves 32*ag* of the heater support 32*a*, respectively, and then the heat generation sheet 22*s* is adhered to the heater support 32*a* via the double-faced adhesive tapes 22*t*. Accordingly, when the heat generation sheet 22*s* is adhered to the heater support 32*a*, the surface of the heat generation sheet 22*s* which faces the fixing sleeve 21 is planar in the axial direction of the fixing sleeve 21. Consequently, the heat generation sheet 22*s* uniformly contacts or is disposed close to the fixing sleeve 21 at the center portion of the heat generation sheet 22*s* corresponding to the conveyance region on the fixing sleeve 21 over which the recording medium P is conveyed, providing improved heating efficiency for heating the fixing sleeve 21 and uniform temperature distribution of the fixing sleeve 21 in the axial direction thereof.

Referring to FIGS. 1, 5A, and 5B, the following describes operation of the fixing device 20 having the above-described structure.

When the image forming apparatus 1 receives an output signal, for example, when the image forming apparatus 1 receives a print request specified by a user by using a control panel or a print request sent from an external device, such as a client computer, the pressure apply-release mechanism applies pressure to the pressing roller 31 to cause the pressing roller 31 to press the fixing sleeve 21 against the nip formation member 26 to form the nip N between the pressing roller 31 and the fixing sleeve 21.

Thereafter, the driver 33 drives and rotates the pressing roller 31 clockwise in FIG. 5A in the rotation direction R2. Accordingly, the fixing sleeve 21 rotates counterclockwise in FIG. 5A in the rotation direction R1 in accordance with rotation of the pressing roller 31. The heat generation sheet 22*s* of the laminated heater 22 supported by the heater support 32*a* contacts the inner circumferential surface of the fixing sleeve 21 with pressure caused by a bias applied to the heater support 32*a* by the biasing members 32*b*.

Simultaneously, an external power source or an internal capacitor supplies power to the laminated heater 22 via a power supply wiring (e.g., the power supply wiring 25 depicted in FIG. 2) to cause the heat generation sheet 22*s* to generate heat. The heat generated by the heat generation sheet 22*s* is transmitted effectively to the fixing sleeve 21 contacting the heat generation sheet 22*s* throughout the entire width of the fixing sleeve 21 in the axial direction thereof, so that the fixing sleeve 21 is heated quickly. Alternatively, heating of the fixing sleeve 21 by the laminated heater 22 may not start simultaneously with driving of the pressing roller 31 by the driver 33. In other words, the laminated heater 22 may start heating the fixing sleeve 21 at a time different from a time at which the driver 33 starts driving the pressing roller 31.

A temperature detector (e.g., the temperature detector 40) is disposed at a position upstream from the nip N in the rotation direction R1 of the fixing sleeve 21. For example, the temperature detector is disposed outside the loop formed by the fixing sleeve 21 to face the outer circumferential surface of the fixing sleeve 21 with or without contacting the fixing sleeve 21. Alternatively, the temperature detector may be disposed inside the loop formed by the fixing sleeve 21. According to this exemplary embodiment, the temperature detector 40 is disposed outside the loop formed by the fixing sleeve 21 without contacting the outer circumferential surface of the fixing sleeve 21 to detect the temperature of the fixing sleeve 21 so that heat generation of the laminated heater 22 is controlled based on a detection result provided by the temperature detector 40 to heat the nip N to a predetermined fixing temperature. When the nip N is heated to the predetermined fixing temperature, the fixing temperature is maintained, and a recording medium P is conveyed to the nip N.

In the fixing device 20 according to this exemplary embodiment, the fixing sleeve 21 and the laminated heater 22 have a small heat capacity, shortening a warm-up time and a first print time of the fixing device 20 while saving energy. Further, the heat generation sheet 22*s* is a resin sheet. Accordingly, even when rotation and vibration of the pressing roller 31 applies stress to the heat generation sheet 22*s* repeatedly, and therefore bends the heat generation sheet 22*s* repeatedly, the heat generation sheet 22*s* is not broken due to wear, resulting in a longer operation of the fixing device 20. Moreover, pressure with which the heat generation sheet 22*s* presses against the fixing sleeve 21 is changed according to the temperature of the lubricant applied between the heat generation sheet 22*s* and the fixing sleeve 21 by using thermal expansion of the heater support 32*a* and bias generated by the biasing members 32*b*. In other words, the fixing device 20 can decrease the rotational torque of the driver 33 that drives and rotates the pressing roller 31 that rotates the fixing sleeve 21 and at the same time optimize pressure with which the heat generation sheet 22*s* presses against the fixing sleeve 21 with no additional pressure adjustment mechanism. Consequently, the heat generation sheet 22*s* heats the fixing sleeve 21 uniformly throughout the entire width of the fixing sleeve 21 in the axial direction thereof. As a result, a toner image is fixed on the recording medium P properly with uniform gloss in the axial direction of the fixing sleeve 21.

Usually, when the image forming apparatus 1 does not receive an output signal, the pressing roller 31 and the fixing sleeve 21 do not rotate and power is not supplied to the laminated heater 22 to save energy. However, in order to restart the fixing device 20 immediately after the image forming apparatus 1 receives an output signal, power can be supplied to the laminated heater 22 while the pressing roller 31 and the fixing sleeve 21 do not rotate. For example, power in an amount sufficient to keep the entire fixing sleeve 21 warm is supplied to the laminated heater 22.

In the fixing device 20 with the above-described configuration shown in FIGS. 5A and 5B, the core holder 28 supports the nip formation member 26, and the nip formation member 26, the core holder 28, the biasing members 32*b*, the heater support 32*a*, and the laminated heater 22 including the heat generation sheet 22*s* are aligned in this order in a pressure application direction D2 in which the pressing roller 31 applies pressure to the nip formation member 26 via the fixing sleeve 21. The heater support 32*a* thermally expands in the direction E opposite the pressure application direction D2. Thus, the nip formation member 26 and the heater support 32*a* stretch the fixing sleeve 21 to cause the heater support 32*a* to apply tension to the fixing sleeve 21 effectively.

The rotating pressing roller 31 pulls and stretches the upstream portion of the fixing sleeve 21 upstream from the nip N in the rotation direction R1 of the fixing sleeve 21 toward the nip N. By contrast, a downstream portion of the fixing sleeve 21 downstream from the nip N in the rotation direction R1 of the fixing sleeve 21 is not stretched and therefore tends to go slack. If the fixing sleeve 21 rotates at a higher speed with the downstream portion thereof slackened, the downstream portion slackens further, destabilizing rotation of the fixing sleeve 21. Moreover, when the slackened fixing sleeve 21 reaches and contacts the heat generation sheet 22*s* supported by the heater support 32*a*, the fixing sleeve 21 does not contact the heat generation sheet 22*s* stably.

Figure 12:
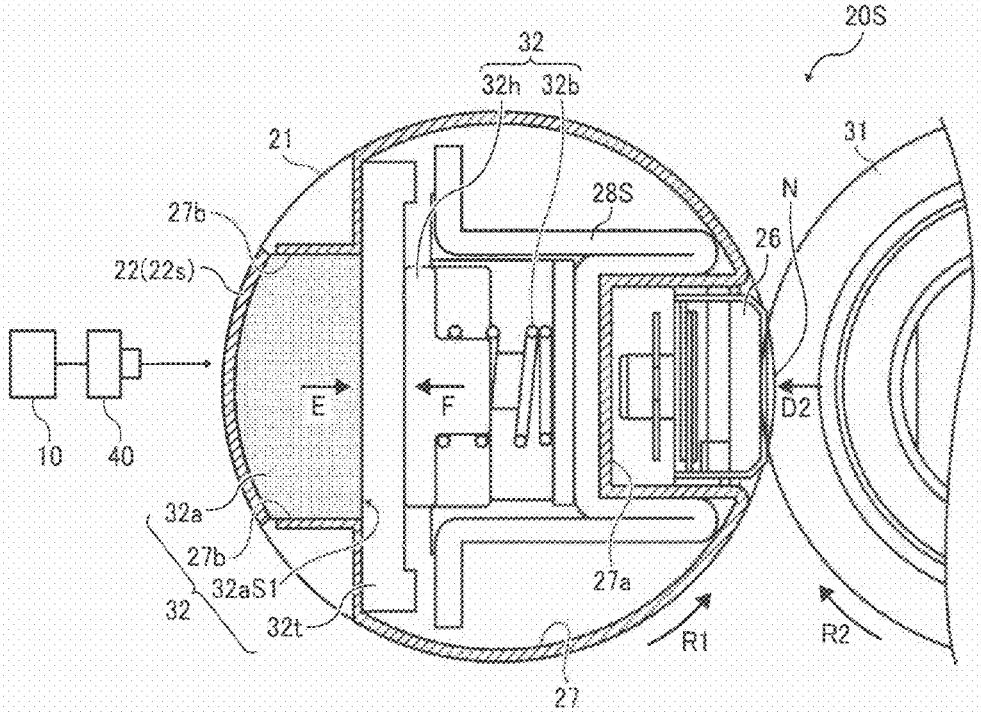
FIG. 12 is a vertical sectional view of a fixing device according to another exemplary embodiment of the present invention.

To address this problem, the fixing device may include a fixing sleeve support 27 that supports the fixing sleeve 21 rotating in the rotation direction R1 as illustrated in FIG. 12. FIG. 12 is a vertical sectional view of a fixing device 20S according to a second illustrative embodiment of the present invention that includes the fixing sleeve support 27. As illustrated in FIG. 12, the fixing sleeve support 27 is disposed inside the loop formed by the fixing sleeve 21 at least at a position downstream from the nip N in the rotation direction R1 of the fixing sleeve 21.

The fixing device 20S is different from the fixing device 20 depicted in FIGS. 5A and 5B in that the fixing device 20S includes the fixing sleeve support 27 and employs a stopper 32*t* instead of the stopper 32*s* depicted in FIGS. 5A and 5B.

The substantially pipe-shaped fixing sleeve support 27 is made of a thin sheet of metal (hereinafter "sheet metal") such as iron or stainless steel that has a generally cylindrical shape. The sheet metal of the fixing sleeve support 27 may have a thickness, for example, in a range of from about 0.1 mm to about 1.0 mm. An outer diameter of the fixing sleeve support 27 is smaller than an inner diameter of the fixing sleeve 21 by a length in a range of from about 0.5 mm to about 1.0 mm. The fixing sleeve support 27 has a concave portion 27*a* facing the nip N, which houses the nip formation member 26. In other words, the nip formation member 26 fits in the concave portion 27*a* of the fixing sleeve support 27 and the concave portion 27*a* of the fixing sleeve support 27 fits in a concave portion of a core holder 28S serving as a support member that faces the nip N and supports the nip formation member 26.

The fixing sleeve support 27 further includes opening walls 27*b* disposed opposite the concave portion 27*a* thereof via the axis of the fixing sleeve 21. The opening walls 27*b* sandwich the heater support 32*a* in the circumferential direction of the fixing sleeve 21 in such a manner that the heat generation sheet 22*s* supported by the heater support 32*a* is exposed to the fixing sleeve 21 to contact the fixing sleeve 21. The heater pressing mechanism 32, which is constructed of the heater support 32*a*, the stopper 32*t*, the biasing members 32*b*, and biasing member holders 32*h* that support the biasing members 32*b*, is provided inside the substantially cylindrical fixing sleeve support 27, providing the above-described effects. With this configuration, the heat generation sheet 22*s* supported by the heater support 32*a* contacts the inner circumferential surface of the fixing sleeve 21 to heat the fixing sleeve 21 effectively.

The concave portion 27*a* of the fixing sleeve support 27 manufactured by bending a portion of the fixing sleeve support 27 that faces the nip N is supported by the core holder 28S in a state in which the concave portion 27*a* of the fixing sleeve support 27 is sandwiched between walls of the concave portion of the core holder 28S in the circumferential direction of the fixing sleeve 21. Further, lateral ends of the fixing sleeve support 27 in a longitudinal direction thereof parallel to the axial direction of the fixing sleeve 21 are supported by the side plates 20*f* depicted in FIG. 7, that is, a part of a frame of the fixing device 20. With this structure, the fixing sleeve support 27 made of rigid metal supports the fixing sleeve 21 to stabilize rotation of the fixing sleeve 21 and at the same time facilitate assembly of the fixing device 20.

In the fixing device 20S according to this exemplary embodiment, the plate-shaped stopper 32*t* is disposed between the core holder 28S and the inner surface 32*a*S1 of the heater support 32*a* in such a manner that the stopper 32*t* is attached to the inner surface 32*a*S1 of the heater support 32*a* and is movable with the heater support 32*a*.

When the fixing device 20S is not yet warmed up at a room temperature of about 20 degrees centigrade, the stopper 32*t* is isolated from the core holder 28S as illustrated in FIG. 12. When the heater support 32*a* thermally expands as the fixing device 20S is warmed up, the stopper 32*t* contacts the core holder 28S.

With this configuration of the stopper 32*t* and the core holder 28S, the fixing device 20S provides effects equivalent to the effects provided by the stopper 32*s* and the core holder 28 of the fixing device 20 depicted in FIGS. 5A and 5B. Specifically, as the heater support 32*a* thermally expands, the stopper 32*t* contacts the core holder 28S. Since the core holder 28S is mounted on the side plates 20*f* (depicted in FIG. 7) of the fixing device 20S, the heater support 32*a* attached to the stopper 32*t* contacted by the stationary core holder 28S cannot expand any more in the direction E that resists bias applied by the biasing members 32*b* in the direction F. Accordingly, thermal expansion thereafter of the heater support 32*a* is converted into pressure of the heater support 32*a* that presses the heat generation sheet 22*s* against the fixing sleeve 21, thus increasing the pressure applied to the heat generation sheet 22*s* by the heater support 32*a*.

As described above, in the fixing device 20S, like in the fixing device 20 depicted in FIGS. 5A and 5B, the pressure with which the heat generation sheet 22*s* presses against the fixing sleeve 21 is adjusted according to the temperature of the lubricant applied between the heat generation sheet 22*s* and the fixing sleeve 21 by using thermal expansion of the heater support 32*a* that supports the heat generation sheet 22*s* and bias generated by the biasing members 32*b*. In other words, the fixing device 20S can decrease the rotational torque of the driver 33 depicted in FIG. 5A that drives and rotates the pressing roller 31 that rotates the fixing sleeve 21 and at the same time optimize the pressure with which the heat generation sheet 22*s* presses against the fixing sleeve 21 with no additional pressure adjustment mechanism.

When the fixing device 20 or the fixing device 20S is installed in the image forming apparatus 1 depicted in FIG. 1, the image forming apparatus 1 shortens its warm-up time and first print time and at the same time forms a toner image fixed on a recording medium P with uniform gloss in the axial direction of the fixing sleeve 21.

The present invention has been described above with reference to the first and second illustrative embodiments. However, the present invention is not limited to the specific embodiments described above, and variations are possible. The following describes several such exemplary variations.

Figure 13A:
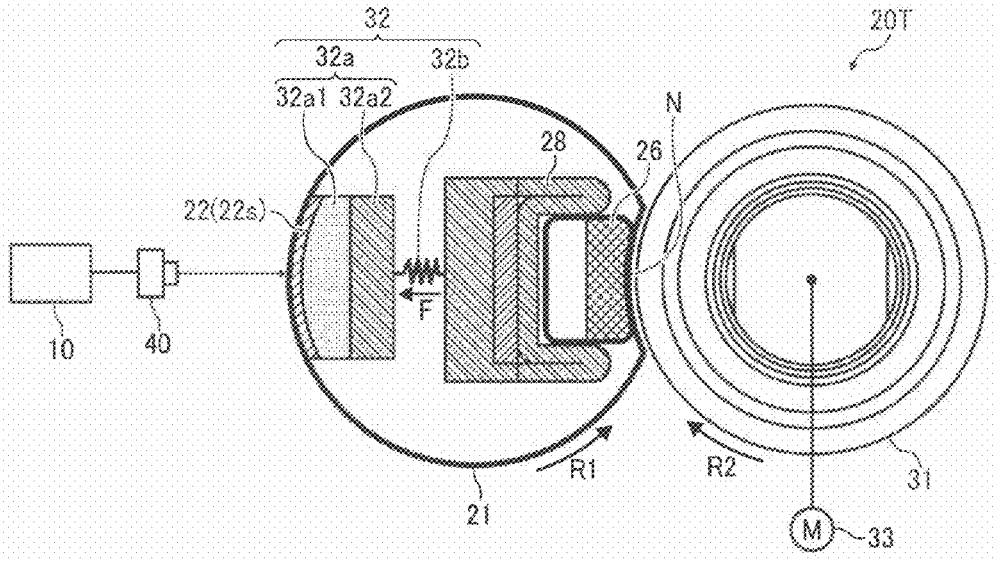
FIG. 13A is a vertical sectional view of a fixing device according to yet another exemplary embodiment of the present invention.
Figure 13B:
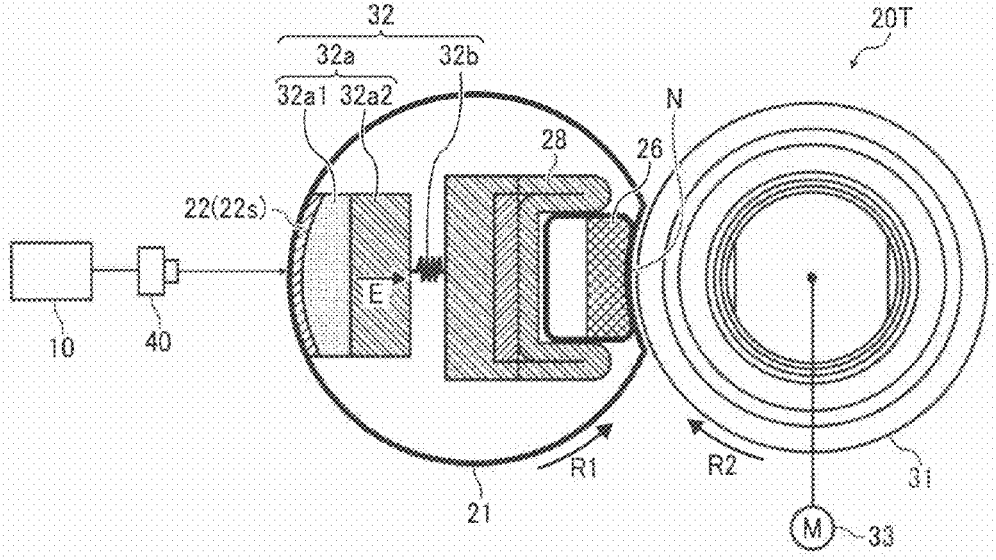
FIG. 13B is a vertical sectional view of the fixing device shown in FIG. 13A when a heater support included in the fixing device is thermally expanded.

Referring to FIGS. 13A and 13B, the following describes a fixing device 20T as one variation of the fixing device 20 depicted in FIGS. 5A and 5B. FIG. 13A is a vertical sectional view of the fixing device 20T when it is not yet warmed up.

FIG. 13B is a vertical sectional view of the fixing device 20T when it is warmed up. The fixing device 20T is different from the fixing device 20 in that the fixing device 20T does not include the stopper 32*s*.

As illustrated in FIGS. 13A and 13B, the heater pressing mechanism 32 is constructed of the heater support 32*a* and the biasing members 32*b*. With this structure of the fixing device 20T, surface pressure with which the heat generation sheet 22*s* presses against the fixing sleeve 21 and rotational torque of the driver 33 that drives and rotates the pressing roller 31 that rotates the fixing sleeve 21 change as described below in accordance with warm-up of the fixing device 20T.

When the fixing device 20T is not yet warmed up at the time it is powered on, the heater support 32*a* is not thermally expanded yet as illustrated in FIG. 13A and therefore presses the heat generation sheet 22*s* against the fixing sleeve 21 with only bias applied by the biasing members 32*b*. In other words, the heat generation sheet 22*s* contacts the inner circumferential surface of the fixing sleeve 21 with reduced pressure.

On the other hand, the lubricant applied to the inner circumferential surface of the fixing sleeve 21 is not yet warmed up and therefore has a higher viscosity that increases frictional resistance between the heat generation sheet 22*s* and the fixing sleeve 21 sliding over the heat generation sheet 22*s*, increasing the rotational torque of the driver 33. The biasing members 32*b* have an increased bias that can maintain the rotational torque of the driver 33 within the allowable range, that is, below the allowable limit.

When power supply to the heat generation sheet 22*s* is started, the heat generation sheet 22*s* generates heat that is transmitted to the fixing sleeve 21 contacting the heat generation sheet 22*s*. Simultaneously, the heat generation sheet 22*s* heats the heater support 32*a* contacting the heat generation sheet 22*s* so that the heater support 32*a* starts its thermal expansion. Specifically, the heater support 32*a* thermally expands toward the core holder 28 in the direction E opposite the direction F in which the biasing members 32*b* apply bias to the heater support 32*a*. As the biasing members 32*b* are compressed by the expanding heater support 32*a*, pressure with which the heat generation sheet 22*s* contacts the inner circumferential surface of the fixing sleeve 21 gradually increases.

On the other hand, as the fixing sleeve 21 is heated, the lubricant applied to the inner circumferential surface of the fixing sleeve 21 is also heated to have a lower viscosity. Accordingly, the rotational torque of the driver 33 decreases gradually. Finally, when the temperature of the heater support 32*a* is maximized, pressure with which the heat generation sheet 22*s* contacts the inner circumferential surface of the fixing sleeve 21 is also maximized at a predetermined level.

Since the lubricant applied on the inner circumferential surface of the fixing sleeve 21 is sufficiently heated and therefore has a lower viscosity, the overall rotational torque of the fixing device 20T is kept low. In other words, the fixing device 20T (e.g., the pressing roller 31) can be driven at a lower rotational torque.

Thus, the fixing device 20T can decrease the rotational torque of the driver 33 that drives and rotates the pressing roller 31 that rotates the fixing sleeve 21 and at the same time optimize the pressure with which the heat generation sheet 22*s* presses against the fixing sleeve 21 with no additional pressure adjustment mechanism.

Figure 14:
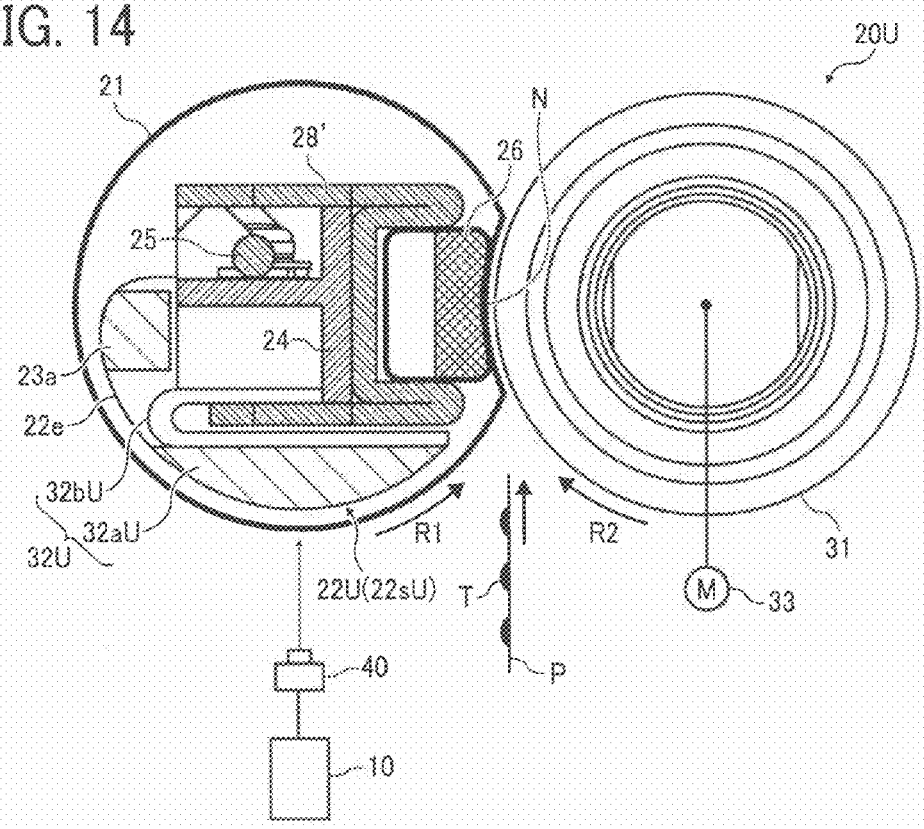
FIG. 14 is a vertical sectional view of a fixing device according to yet another exemplary embodiment of the present invention.

Referring to FIG. 14, the following describes a fixing device 20U as another variation of the fixing device 20 depicted in FIGS. 5A and 5B. FIG. 14 is a vertical sectional view of the fixing device 20U. The fixing device 20U includes a laminated heater 22U disposed at a position closer to the nip N than in the fixing device 20 in the rotation direction R1 of the fixing sleeve 21.

Specifically, the laminated heater 22U is disposed at a position upstream from the nip N and between the nip N and the position opposite the nip N via the axis of the fixing sleeve 21 in the rotation direction R1 of the fixing sleeve 21, that is, in a lower part inside the loop formed by the fixing sleeve 21 in FIG. 14. Further, the stopper 32*s* depicted in FIGS. 5A and 5B is not provided in the fixing device 22U. Instead of the heater pressing mechanism 32 depicted in FIGS. 5A and 5B, the fixing device 20U includes a heater pressing mechanism 32U constructed of a heater support 32*a*U and a biasing member 32*b*U (e.g., a plate spring) that applies bias downward in FIG. 14 to the heater support 32*a*U to cause the heater support 32*a*U to press a heat generation sheet 22*s*U of the laminated heater 22U against the fixing sleeve 21.

The laminated heater 22U includes an electrode terminal 22*e* attached to the heat generation sheet 22*s*U, wound around a heater support 23*a*, and connected to the power supply wiring 25. Thus, the electrode terminal 22*e* supplies power received from an external power source or an internal capacitor to the heat generation sheet 22*s*U.

With this configuration, the fixing device 20U can also provide effects equivalent to the effects of the fixing device 20. In other words, the fixing device 20U can decrease the rotational torque of the driver 33 that drives and rotates the pressing roller 31 that rotates the fixing sleeve 21 and at the same time optimize pressure with which the heat generation sheet 22*s*U presses against the fixing sleeve 21 with no additional pressure adjustment mechanism.

It is to be noted that in the fixing devices 20, 20S, 20T, and 20U depicted in FIGS. 5A, 12, 13A, and 14, respectively, when the fixing sleeve 21 is not yet warmed up and therefore the heater support 32*a* or 32*a*U has a low temperature, the heater support 32*a* or 32*a*U may press the laminated heater 22 or 22U against the fixing sleeve 21 with reduced pressure, increasing thermal resistance between the laminated heater 22 or 22U and the fixing sleeve 21 contacting each other. Accordingly, heat is not transmitted from the laminated heater 22 or 22U to the fixing sleeve 21 smoothly and therefore the laminated heater 22 or 22U is overheated, resulting in malfunction of the laminated heater 22 or 22U. To address this problem, less power may be supplied to the laminated heater 22 or 22U to heat it slowly. However, this solution has a drawback in that it takes a longer time to warm up the fixing sleeve 21.

By contrast, when the fixing sleeve 21 is warmed up and therefore the heater support 32*a* or 32*a*U has a high temperature, the heater support 32*a* or 32*a*U thermally expands to press the laminated heater 22 or 22U against the fixing sleeve 21 with increased pressure, resulting in smooth transmission of heat from the laminated heater 22 or 22U to the fixing sleeve 21. For example, even when the laminated heater 22 or 22U generates an increased amount of heat, heat is transmitted from the laminated heater 22 or 22U to the fixing sleeve 21 effectively. Accordingly, the laminated heater 22 or 22U is not overheated and at the same time the laminated heater 22 or 22U heats the fixing sleeve 21 quickly, shortening a warm-up time of the fixing sleeve 21.

As described above, as the temperature of the heater support 32*a* or 32*a*U increases, thermal expansion of the heater support 32*a* or 32*a*U also increases to press the laminated heater 22 or 22U against the fixing sleeve 21 with increased pressure, increasing the temperature of the fixing sleeve 21. By contrast, as the temperature of the heater support 32*a* or 32*a*U decreases, thermal expansion of the heater support 32*a* or 32*a*U also decreases to press the laminated heater 22 or 22U against the fixing sleeve 21 with decreased pressure, decreasing the temperature of the fixing sleeve 21. Thus, there is a correlation between the temperature of the heater support 32*a* or 32*a*U and the temperature of the fixing sleeve 21 during warm-up of the fixing sleeve 21.

Focusing on such correlation, an improved method of controlling heating of the fixing sleeve 21 is proposed below, which shortens the warm-up time of the fixing sleeve 21 while suppressing overheating of the laminated heater 22 or 22U. Specifically, power supplied to the laminated heater 22 or 22U is adjusted to change the speed at which the temperature of the laminated heater 22 or 22U increases based on the temperature of the fixing sleeve 21 at the position thereof at which the fixing sleeve 21 is heated by the laminated heater 22 or 22U during warm-up of the fixing sleeve 21 by the laminated heater 22 or 22U. Referring to FIGS. 5A, 12, 13A, and 14, the following describes examples of the method of controlling heating of the fixing sleeve 21 of the fixing devices 20, 20S, 20T, and 20U.

As illustrated in FIGS. 5A, 12, 13A, and 14, each of the fixing devices 20, 20S, 20T, and 20U includes the temperature detector 40 that detects the temperature of the fixing sleeve 21 at the position thereof at which the fixing sleeve 21 contacts the laminated heater 22 or 22U. While the fixing sleeve 21 is heated by the laminated heater 22 or 22U during warm-up, for example, power supplied to the laminated heater 22 or 22U is adjusted based on the temperature of the fixing sleeve 21 detected by the temperature detector 40.

The temperature detector 40 is a temperature sensor that detects the temperature of the outer circumferential surface of the fixing sleeve 21 without contacting the fixing sleeve 21. The temperature detector 40 detects the temperature of the fixing sleeve 21 at a detection position on the outer circumferential surface thereof, which corresponds to a contact region of the fixing sleeve 21 in which the laminated heater 22 or 22U contacts and heats the inner circumferential surface of the fixing sleeve 21. Preferably, the detection position is not in a downstream part of the contact region of the fixing sleeve 21 contacting the laminated heater 22 or 22U, provided downstream from the nip N and upstream from a center of the laminated heater 22 or 22U in the rotation direction R1 of the fixing sleeve 21, because the laminated heater 22 or 22U starts heating the fixing sleeve 21 in the downstream part of the contact region of the fixing sleeve 21 contacting the laminated heater 22 or 22U. More preferably, the detection position is at a position on the fixing sleeve 21 at which bias applied by the biasing members 32*b* acts on the fixing sleeve 21 most strongly. For example, in the fixing devices 20, 20S, and 20T depicted in FIGS. 5A, 12, and 13A, respectively, the detection position is at the position opposite the nip N via the axis of the fixing sleeve 21. By contrast, in the fixing device 20U depicted in FIG. 14, the detection position is at a center between the nip N and the position opposite the nip N via the axis of the fixing sleeve 21 in the rotation direction R1 of the fixing sleeve 21, that is, at the lowest position on the fixing sleeve 21 in FIG. 14. Moreover, the temperature detector 40 may detect the temperature of a center portion of the fixing sleeve 21 in the axial direction thereof.

An upper limit of power supplied to the laminated heater 22 or 22U in the case in which the temperature of the fixing sleeve 21 detected by the temperature detector 40 while the laminated heater 22 or 22U heats the fixing sleeve 21 is lower than a predetermined temperature A is smaller than that in the case in which the temperature of the fixing sleeve 21 detected by the temperature detector 40 is not lower than the predetermined temperature A. The upper limit of power supplied to the laminated heater 22 or 22U corresponding to the temperature of the fixing sleeve 21 detected by the temperature detector 40 is shown in Table 1 below.

TABLE 1

| Temperature detected by temperature detector 40 | Upper limit of power supplied to laminated heater |
|---|---|
| Lower than 100° C. | 800 W |
| Not lower than 100° C. | 1,200 W |

In Table 1, the predetermined temperature A is 100 degrees centigrade. More generally, the predetermined temperature A is defined as a temperature at which, even if maximum power available in the fixing device 20, 20S, 20T, or 20T is supplied to the laminated heater 22 or 22U when the temperature of the fixing sleeve 21 detected by the temperature detector 40 reaches the predetermined temperature A, the laminated heater 22 or 22U presses against the fixing sleeve 21 with predetermined pressure or greater to transmit heat from the laminated heater 22 or 22U to the fixing sleeve 21 effectively and the temperature of the laminated heater 22 or 22U does not exceed its upper temperature limit for heat resistance before the temperature of the fixing sleeve 21 reaches its target temperature.

Figure 15:
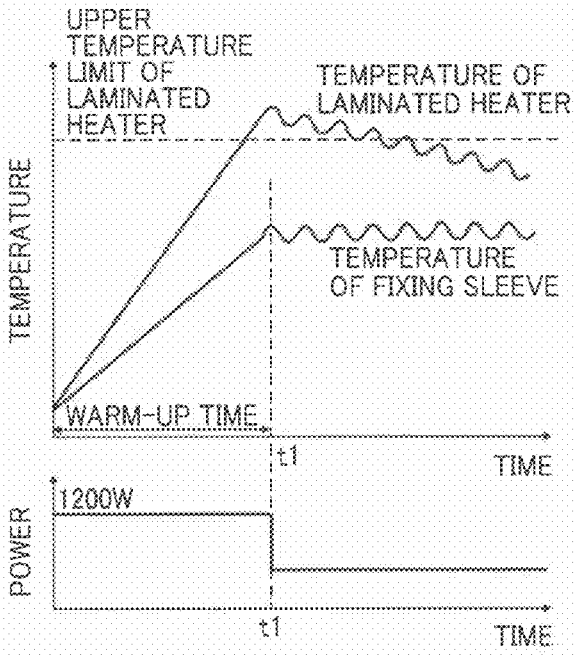
FIG. 15 is a graph illustrating a temperature profile of a laminated heater and a fixing sleeve included in the fixing devices shown in FIGS. 5A, 12, 13A, and 14 with a constant upper limit of 1,200 W of power supplied to the laminated heater during warm-up.

The upper limit of power supplied to the laminated heater 22 or 22U of 1,200 W shown in Table 1 denotes the power with which the temperature of the laminated heater 22 or 22U reaches its upper temperature limit for heat resistance before the temperature of the fixing sleeve 21 reaches its target temperature when the power is supplied to the laminated heater 22 or 22U during warm-up of the fixing sleeve 21, that is, the power with which the laminated heater 22 or 22U is overheated in a short time, as shown in FIG. 15.

FIG. 15 is a graph illustrating a temperature profile of the laminated heater 22 or 22U and the fixing sleeve 21 when the upper limit of power supplied to the laminated heater 22 or 22U during warm-up is constant at 1,200 W regardless of output of the temperature detector 40.

With the low temperature of the fixing sleeve 21 and the laminated heater 22 or 22U when warm-up of the fixing sleeve 21 is started, for example, the heater support 32*a* or 32*a*U thermally expands slightly and therefore increased thermal resistance between the fixing sleeve 21 and the laminated heater 22 or 22U contacting the fixing sleeve 21 disturbs smooth transmission of heat from the laminated heater 22 or 22U to the fixing sleeve 21. Accordingly, as the temperature of the fixing sleeve 21 increases, the temperature of the laminated heater 22 or 22U increases sharply, enlarging a temperature differential between the laminated heater 22 or 22U and the fixing sleeve 21 over time. As a result, the temperature of the laminated heater 22 or 22U exceeds its upper temperature limit for heat resistance before the temperature of the fixing sleeve 21 reaches its target temperature.

Figure 16:
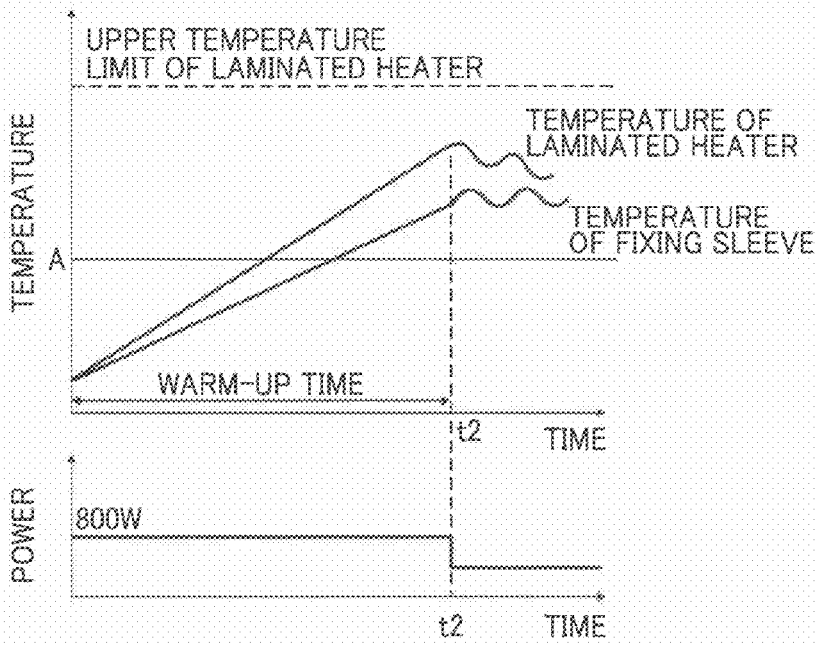
FIG. 16 is a graph illustrating a temperature profile of a laminated heater and a fixing sleeve included in the fixing devices shown in FIGS. 5A, 12, 13A, and 14 with a constant upper limit of 800 W of power supplied to the laminated heater during warm-up.

By contrast, the upper limit of power supplied to the laminated heater 22 or 22U of 800 W shown in Table 1 denotes the power with which, even if the power is supplied to the laminated heater 22 or 22U during warm-up, the temperature of the fixing sleeve 21 can reach its target temperature before the temperature of the laminated heater 22 or 22U reaches its upper temperature limit for heat resistance, as shown in FIG. 16.

FIG. 16 is a graph illustrating a temperature profile of the laminated heater 22 or 22U and the fixing sleeve 21 when the upper limit of power supplied to the laminated heater 22 or 22U during warm-up is constant at 800 W regardless of output of the temperature detector 40.

With the limited maximum power of 800 W supplied to the laminated heater 22 or 22U, the temperature differential between the fixing sleeve 21 and the laminated heater 22 or 22U does not increase compared to the configuration shown in FIG. 15, and therefore the temperature of the fixing sleeve 21 reaches its target temperature before the temperature of the laminated heater 22 or 22U reaches its upper temperature limit for heat resistance. However, slow temperature increase of the fixing sleeve 21 makes a warm-up time t2 of the fixing sleeve 21 shown in FIG. 16 longer than a warm-up time t1 of the fixing sleeve 21 shown in FIG. 15.

Referring to FIGS. 1, 5A, 12, 13A, and 14, the following describes operation of the fixing devices 20, 20S, 20T, and 20U having the above-described structure.

When the image forming apparatus 1 receives an output signal, for example, when the image forming apparatus 1 receives a print request specified by a user by using a control panel or a print request sent from an external device, such as a client computer, the image forming apparatus 1 starts warm-up. Specifically, in the fixing device 20, 20S, 20T, or 20U, the pressure apply-release mechanism applies pressure to the pressing roller 31 to cause the pressing roller 31 to press the fixing sleeve 21 against the nip formation member 26 to form the nip N between the pressing roller 31 and the fixing sleeve 21.

Thereafter, the driver 33 drives and rotates the pressing roller 31 clockwise in FIG. 5A in the rotation direction R2. Accordingly, the fixing sleeve 21 rotates counterclockwise in FIG. 5A in the rotation direction R1 in accordance with rotation of the pressing roller 31 in a state in which bias applied by the biasing members 32*b* or 32*b*U causes the heat generation sheet 22*s* or 22*s*U to contact and press against the inner circumferential surface of the fixing sleeve 21.

Simultaneously, an external power source or an internal capacitor supplies power to the laminated heater 22 or 22U via the power supply wiring 25 to cause the heat generation sheet 22*s* or 22*s*U to generate heat. The heat generated by the heat generation sheet 22*s* or 22*s*U is transmitted to the fixing sleeve 21 throughout the entire width of the fixing sleeve 21 in the axial direction of the fixing sleeve 21, so that the fixing sleeve 21 is heated quickly. Alternatively, heating of the fixing sleeve 21 by the laminated heater 22 or 22U may not start simultaneously with driving of the pressing roller 31 by the driver 33. In other words, the laminated heater 22 or 22U may start heating the fixing sleeve 21 at a time different from a time at which the driver 33 starts driving the pressing roller 31.

The power supplied to the laminated heater 22 or 22U via the power supply wiring 25 is determined based on Table 1. For example, when the image forming apparatus 1 receives the output signal, the temperature detector 40 detects the temperature of the fixing sleeve 21. If the detected temperature is lower than 100 degrees centigrade, the upper limit of power supplied to the laminated heater 22 or 22U is set to 800 W. By contrast, if the detected temperature is not lower than 100 degrees centigrade, the upper limit of power supplied to the laminated heater 22 or 22U is set to 1,200 W. During warm-up, the temperature detector 40 detects the temperature of the fixing sleeve 21 every 100 msec. The controller 10 adjusts the upper limit of power supplied to the laminated heater 22 or 22U based on the detected temperature of the fixing sleeve 21 as described above, as shown in FIGS. 17 and 18.

Figure 17:
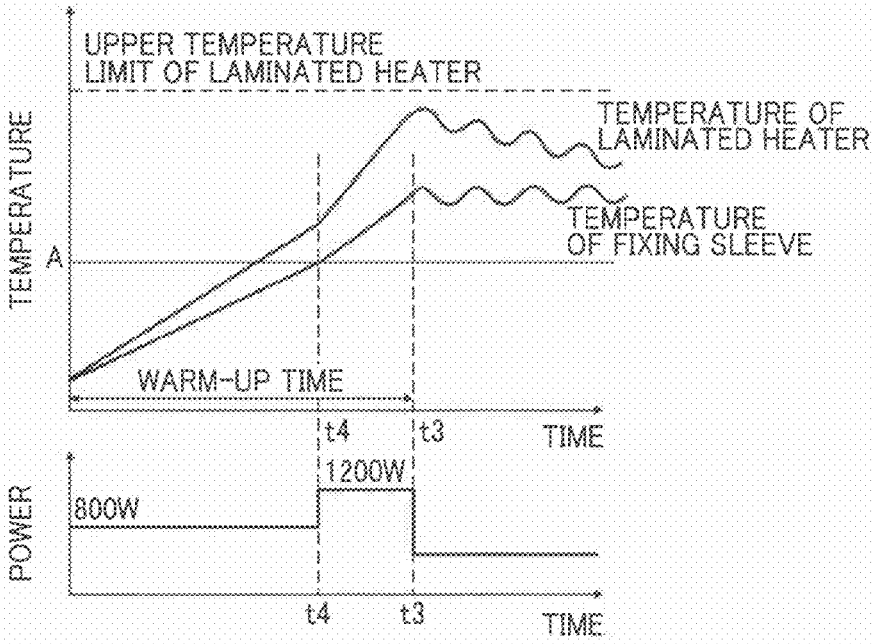
FIG. 17 is a graph illustrating a temperature profile of a laminated heater and a fixing sleeve included in the fixing devices shown in FIGS. 5A, 12, 13A, and 14 with a variable upper limit of power supplied to the laminated heater during warm-up.
Figure 18:
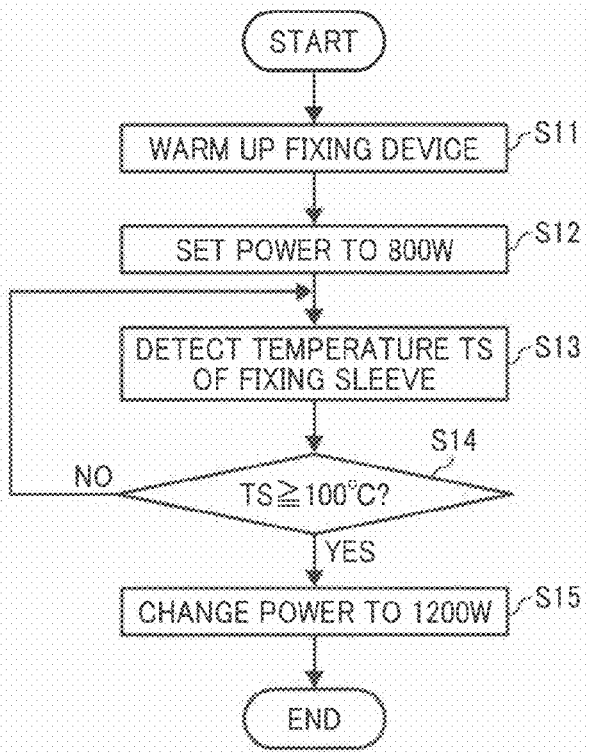
FIG. 18 is a flowchart illustrating steps of controlling an upper limit of power supplied to a laminated heater included in the fixing devices shown in FIGS. 5A, 12, 13A, and 14 based on a temperature of a fixing sleeve detected by a temperature detector included in the fixing devices.

FIG. 17 is a graph illustrating a temperature profile of the laminated heater 22 or 22U and the fixing sleeve 21 when the upper limit of power supplied to the laminated heater 22 or 22U during warm-up is changeable based on the detected temperature of the fixing sleeve 21. FIG. 18 is a flowchart illustrating steps of controlling the upper limit of power supplied to the laminated heater 22 or 22U based on the temperature of the fixing sleeve 21 detected by the temperature detector 40.

As illustrated in FIG. 18, in step S11, warm-up of the fixing device 20, 20S, 20T, or 20U is started. With the low temperature of the laminated heater 22 or 22U and the fixing sleeve 21 when warm-up of the fixing sleeve 21 is started, the temperature of the fixing sleeve 21 detected by the temperature detector 40 is lower than 100 degrees centigrade.

In step S12, the controller 10 sets the upper limit of power supplied to the laminated heater 22 or 22U to 800 W.

Thereafter, the temperature of the fixing sleeve 21 heated by the laminated heater 22 or 22U increases. However, before the temperature of the fixing sleeve 21 detected by the temperature detector 40 reaches 100 degrees centigrade, the controller 10 determines that thermal expansion of the heater support 32*a* or 32*a*U is small and therefore thermal resistance between the fixing sleeve 21 and the laminated heater 22 or 22U contacting the fixing sleeve 21 is large, restricting power supplied to the laminated heater 22 or 22U to 800 W at maximum. Accordingly, the temperature of the laminated heater 22 or 22U increases slowly, maintaining the small temperature differential between the laminated heater 22 or 22U and the fixing sleeve 21.

In step S13, the temperature detector 40 detects a temperature TS of the fixing sleeve 21.

In step S14, the controller 10 determines whether or not the detected temperature TS of the fixing sleeve 21 is not lower than 100 degrees centigrade.

In step S15, the controller 10 changes the upper limit of power supplied to the laminated heater 22 or 22U to 1,200 W, when the temperature TS of the fixing sleeve 21 detected by the temperature detector 40 is 100 degrees centigrade or higher at a warm-up time t4 depicted in FIG. 17 in step S14. Since thermal expansion of the heater support 32*a* or 32*a*U decreases thermal resistance between the fixing sleeve 21 and the laminated heater 22 or 22U contacting the fixing sleeve 21, heat generated by the laminated heater 22 or 22U is transmitted to the fixing sleeve 21 effectively even with the increased heat generation amount of the laminated heater 22 or 22U. Accordingly, even at a warm-up time t3 depicted in FIG. 17 at which warm-up of the fixing sleeve 21 is finished, the temperature of the laminated heater 22 or 22U is maintained at its upper temperature limit for heat resistance or lower. For example, the warm-up time t3 is shorter than the warm-up time t2 shown in FIG. 16 by one second or more.

With the control described above, the controller 10 estimates an amount of thermal expansion of the heater support 32*a* or 32*a*U by using the temperature detector 40 that detects the temperature of the fixing sleeve 21 correlated with the temperature of the heater support 32*a* or 32*a*U, and adjusts power supplied to the laminated heater 22 or 22U according to the amount of thermal expansion of the heater support 32*a* or 32*a*U, that is, pressure with which the laminated heater 22 or 22U presses against the fixing sleeve 21, preventing overheating of the laminated heater 22 or 22U due to insufficient heat transmission from the laminated heater 22 or 22U to the fixing sleeve 21 and shortening the warm-up time of the fixing sleeve 21. In other words, when the temperature of the laminated heater 22 or 22U and the heater support 32*a* or 32*a*U is low soon after warm-up of the fixing sleeve 21 is started, thermal expansion of the heater support 32*a* or 32*a*U is small, and therefore the heater support 32*a* or 32*a*U presses the laminated heater 22 or 22U against the fixing sleeve 21 with reduced pressure, increasing thermal resistance between the fixing sleeve 21 and the laminated heater 22 or 22U contacting the fixing sleeve 21. To address this problem, the controller 10 decreases the upper limit of power supplied to the laminated heater 22 or 22U when the temperature of the fixing sleeve 21 detected by the temperature detector 40 is low. Accordingly, the laminated heater 22 or 22U is heated slowly to prevent overheating of the laminated heater 22 or 22U due to insufficient heat transmission from the laminated heater 22 or 22U to the fixing sleeve 21.

By contrast, when the heater support 32*a* or 32*a*U is warmed and therefore the temperature of the laminated heater 22 or 22U and the heater support 32*a* or 32*a*U increases, thermal expansion of the heater support 32*a* or 32*a*U is large, and therefore the heater support 32*a* or 32*a*U presses the laminated heater 22 or 22U against the fixing sleeve 21 with increased pressure, decreasing thermal resistance between the fixing sleeve 21 and the laminated heater 22 or 22U contacting the fixing sleeve 21. To address this problem, the controller 10 increases the upper limit of power supplied to the laminated heater 22 or 22U when the temperature of the fixing sleeve 21 detected by the temperature detector 40 is high. Accordingly, the laminated heater 22 or 22U is heated quickly to shorten the warm-up time of the fixing sleeve 21. Thus, the above-described control for heating the fixing sleeve 21 can improve energy efficiency.

After the fixing device 20, 20S, 20T, or 20U is powered off for a long time, the temperature of the heater support 32*a* or 32*a*U is decreased to an ambient temperature. Especially, when the fixing device 20, 20S, 20T, or 20U is cooled to a low ambient temperature in the winter morning, for example, it takes longer time for the heater support 32*a* or 32*a*U to expand to a predetermined size, keeping large thermal resistance between the fixing sleeve 21 and the laminated heater 22 or 22U contacting the fixing sleeve 21 for longer time. To address this problem, the above-described control for heating the fixing sleeve 21 by switching the upper limit of power supplied to the laminated heater 22 or 22U can be performed based on the ambient temperature near the fixing device 20, 20S, 20T, or 20U in addition to the temperature of the fixing sleeve 21 detected by the temperature detector 40.

For example, as illustrated in FIG. 1, the ambient temperature detector 41, which detects the ambient temperature near the fixing device 20, is disposed near the fixing device 20. The controller 10 changes power supplied to the laminated heater 22 based on the temperature of the fixing sleeve 21 detected by the temperature detector 40 and the ambient temperature near the fixing device 20 while the laminated heater 22 heats the fixing sleeve 21 during warm-up. In the image forming apparatus 1 depicted in FIG. 1, the ambient temperature detector 41 is disposed outside the frame of the fixing device 20. The ambient temperature detector 41 may be provided in the fixing devices 20S, 20T, and 20U depicted in FIGS. 12, 13A, and 14, respectively.

When the temperature of the fixing sleeve 21 detected by the temperature detector 40 is lower than the predetermined temperature A while the laminated heater 22 heats the fixing sleeve 21, the controller 10 adjusts the upper limit of power supplied to the laminated heater 22 to be smaller than the upper limit thereof when the temperature of the fixing sleeve 21 detected by the temperature detector 40 is not lower than the predetermined temperature A. Further, when the ambient temperature near the fixing device 20 detected by the ambient temperature detector 41 is lower than a predetermined ambient temperature B, the controller 10 adjusts the upper limit of power supplied to the laminated heater 22 to be smaller than the upper limit thereof when the ambient temperature near the fixing device 20 detected by the ambient temperature detector 41 is not lower than the predetermined ambient temperature B. The upper limit of power supplied to the laminated heater 22 corresponding to the temperature of the fixing sleeve 21 detected by the temperature detector 40 and the ambient temperature near the fixing device 20 detected by the ambient temperature detector 41 is shown in Table 2 below. In Table 2, the predetermined ambient temperature B is 20 degrees centigrade.

TABLE 2

| | | Temperature detected by ambient temperature detector 41 | |
|---|---|---|---|
| | | Lower than 20° C. | Not lower than 20° C. |
| Temperature detected by temperature detector 40 | Lower than 100° C. | 600 W | 800 W |
| | Not lower than 100° C. | 1,200 W | 1,200 W |

Figure 19:
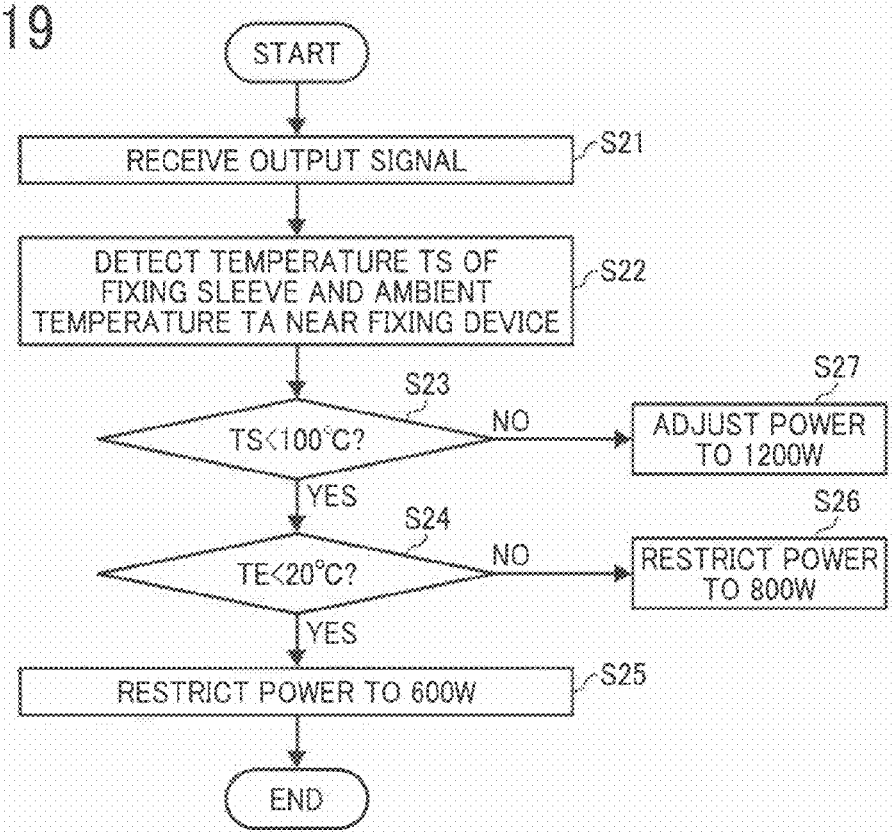
FIG. 19 is a flowchart illustrating steps of controlling an upper limit of power supplied to a laminated heater included in the fixing devices shown in FIGS. 5A, 12, 13A, and 14 based on a temperature of a fixing sleeve detected by a temperature detector disposed inside the fixing devices and an ambient temperature near the fixing devices detected by the ambient temperature detector.

According to this exemplary embodiment, when warm-up is started, the controller 10 determines power supplied to the laminated heater 22 according to Table 2. FIG. 19 is a flowchart illustrating steps in a process of controlling the upper limit of power supplied to the laminated heater 22 based on the temperature of the fixing sleeve 21 detected by the temperature detector 40 and the ambient temperature near the fixing device 20 detected by the ambient temperature detector 41.

As illustrated in FIG. 19, in step S21, the image forming apparatus 1 receives an output signal.

In step S22, the temperature detector 40 detects a temperature TS of the fixing sleeve 21 and the ambient temperature detector 41 detects an ambient temperature TA near the fixing device 20.

Thereafter, as shown in Table 2, the controller 10 checks the detected temperature TS of the fixing sleeve 21 and the detected ambient temperature TA near the fixing device 20.

Specifically, in step S23, the controller 10 determines whether or not the temperature TS of the fixing sleeve 21 is lower than 100 degrees centigrade.

In step S24, the controller 10 determines whether or not the ambient temperature TA near the fixing device 20 is lower than 20 degrees centigrade, when the controller 10 determines that the temperature TS of the fixing sleeve 21 is lower than 100 degrees centigrade in step S23.

In step S25, the controller 10 restricts the upper limit of power supplied to the laminated heater 22 to 600 W, when the controller 10 determines that the ambient temperature TA near the fixing device 20 is lower than 20 degrees centigrade in step S24.

In step S26, the controller 10 restricts the upper limit of power supplied to the laminated heater 22 to 800 W, when the controller 10 determines that the ambient temperature TA near the fixing device 20 is not lower than 20 degrees centigrade in step S24.

In step S27, the controller 10 adjusts the upper limit of power supplied to the laminated heater 22 to 1,200 W, when the temperature TS of the fixing sleeve 21 is not lower than 100 degrees centigrade in step S23.

In other words, when the temperature TS of the fixing sleeve 21 detected by the temperature detector 40 is lower than 100 degrees centigrade and at the same time the ambient temperature TA near the fixing device 20 detected by the ambient temperature detector 41 is lower than 20 degrees centigrade, the controller 10 determines that thermal resistance between the laminated heater 22 and the fixing sleeve 21 contacting the laminated heater 22 is largest, and restricts the upper limit of power supplied to the laminated heater 22 to 600 W. Alternatively, when the temperature TS of the fixing sleeve 21 detected by the temperature detector 40 is lower than 100 degrees centigrade and at the same time the ambient temperature TA near the fixing device 20 detected by the ambient temperature detector 41 is not lower than 20 degrees centigrade, the controller 10 restricts the upper limit of power supplied to the laminated heater 22 to 800 W. Yet alternatively, when the temperature TS of the fixing sleeve 21 detected by the temperature detector 40 is not lower than 100 degrees centigrade, the controller 10 adjusts the upper limit of power supplied to the laminated heater 22 to 1,200 W.

During warm-up, temperature detection by the temperature detector 40 and the ambient temperature detector 41 is performed every 100 msec, and the controller 10 changes the upper limit of power supplied to the laminated heater 22 based on the temperature of the fixing sleeve 21 detected by the temperature detector 40 and the ambient temperature near the fixing device 20 detected by the ambient temperature detector 41 as described above.

With the above-described control, the controller 10 estimates an amount of thermal expansion of the heater support 32*a* based on both the temperature of the fixing sleeve 21 and the ambient temperature near the fixing device 20, and then adjusts power supplied to the laminated heater 22 according to thermal expansion of the heater support 32*a*, that is, pressure with which the heater support 32*a* presses the laminated heater 22 against the fixing sleeve 21, preventing overheating of the laminated heater 22 and minimizing the warm-up time of the fixing sleeve 21. Specifically, soon after warm-up is started, when both the temperature of the laminated heater 22 and the heater support 32*a* and the ambient temperature near the fixing device 20 are low, thermal expansion of the heater support 32*a* is small and therefore the heater support 32*a* presses the laminated heater 22 against the fixing sleeve 21 with reduced pressure, maximizing thermal resistance between the fixing sleeve 21 and the laminated heater 22 contacting the fixing sleeve 21. To address this problem, the controller 10 minimizes the upper limit of power supplied to the laminated heater 22 when the temperature of the fixing sleeve 21 detected by the temperature detector 40 and the ambient temperature near the fixing device 20 detected by the ambient temperature detector 41 are low, thus slowing temperature increase of the laminated heater 22 and preventing overheating of the laminated heater 22 due to insufficient heat transmission from the laminated heater 22 to the fixing sleeve 21.

Referring to FIGS. 1, 5A, 12, 13A, and 14, the following describes the effects provided by the fixing devices 20, 20S, 20T, and 20U and the image forming apparatus 1 incorporating the same.

In the fixing device (e.g., the fixing device 20, 20S, 20T, or 20U), pressure with which the laminated heater (e.g., the laminated heater 22 or 22U) presses against the fixing member (e.g., the fixing sleeve 21) is changed in accordance with the temperature of the heated lubricant by utilizing thermal expansion of the heater support (e.g., the heater support 32*a* or 32*a*U) that supports the laminated heater and bias of the biasing members (e.g., the biasing members 32*b* or 32*b*U). Thus, the fixing device can decrease the rotational torque of the driver (e.g., the driver 33) of the fixing device and at the same time optimize pressure with which the laminated heater presses against the fixing member with no additional pressure adjustment mechanism.

The image forming apparatus (e.g., the image forming apparatus 1) incorporating the fixing device can shorten the warm-up time and the first print time and form a toner image fixed on a recording medium with uniform gloss in the axial direction of the fixing member.

In the fixing devices 20, 20S, 20T, and 20U according to the above-described exemplary embodiments, the pressing roller 31 is used as a pressing member. Alternatively, a pressing belt or the like may be used as a pressing member to provide effects equivalent to the effects provided by the pressing roller 31. Further, the fixing sleeve 21 is used as a fixing member. Alternatively, an endless fixing belt, an endless fixing film, or the like may be used as a fixing member.

The present invention has been described above with reference to specific exemplary embodiments. Note that the present invention is not limited to the details of the embodiments described above, but various modifications and enhancements are possible without departing from the spirit and scope of the invention. It is therefore to be understood that the present invention may be practiced otherwise than as specifically described herein. For example, elements and/or features of different illustrative exemplary embodiments may be combined with each other and/or substituted for each other within the scope of the present invention.

What is claimed is:

1. A fixing device comprising:

an endless belt-shaped fixing member rotating in a predetermined direction of rotation, formed into a loop;

a nip formation member provided inside the loop formed by the fixing member;

a pressing member provided outside the loop formed by the fixing member to press the fixing member against the nip formation member to form a nip between the pressing member and the fixing member;

a laminated heater contacting an inner circumferential surface of the fixing member to generate heat to be transmitted to the fixing member;

a heater support provided inside the loop formed by the fixing member and including a first surface that supports the laminated heater in a state in which the laminated heater is provided between the fixing member and the heater support and a second surface disposed back-to-back to the first surface, the heater support thermally expanding in a first direction due to heat generated by the laminated heater;

a support member fixedly provided inside the loop formed by the fixing member and isolated from the second surface of the heater support; and a biasing member provided between the support member and the second surface of the heater support to apply bias to the heater support in a second direction opposite the first direction and in which the heater support presses the laminated heater against the inner circumferential surface of the fixing member, wherein the heater support comprises a heat-resistant resin foam member.

2. The fixing device according to claim 1, further comprising a lubricant applied to the inner circumferential surface of the fixing member.

3. The fixing device according to claim 1, wherein the laminated heater comprises a flexible heat generation sheet having a predetermined width in an axial direction of the fixing member and a predetermined length in a circumferential direction of the fixing member, the heat generation sheet comprising:

an insulating base layer;

a resistant heat generation layer provided on the base layer to generate heat and including conductive particles dispersed in a heat-resistant resin; and an electrode layer provided on the base layer to supply power to the resistant heat generation layer.

4. The fixing device according to claim 1, wherein the pressing member applies pressure in a pressure application direction to the nip formation member supported by the support member, and the nip formation member, the support member, the biasing member, the heater support, and the laminated heater are aligned in this order in the pressure application direction of the pressing member.

5. The fixing device according to claim 1, further comprising a stopper provided between the support member and the second surface of the heater support to restrict thermal expansion of the heater support in the first direction.

6. The fixing device according to claim 1, wherein the heater support further comprises a heat-resistant rubber member having a thermal expansion coefficient greater than that of the heat-resistant resin foam member.

7. The fixing device according to claim 1, further comprising:

a fixing member temperature detector facing the fixing member at a position at which the fixing member contacts the laminated heater to detect a temperature of the fixing member; and a controller connected to the fixing member temperature detector to control power supplied to the laminated heater based on the temperature of the fixing member detected by the fixing member temperature detector as the laminated heater heats the fixing member.

8. The fixing device according to claim 7, further comprising an ambient temperature detector provided outside a frame of the fixing device to detect an ambient temperature near the fixing device, wherein the controller changes power supplied to the laminated heater based on the temperature of the fixing member detected by the fixing member temperature detector and the ambient temperature detected by the ambient temperature detector as the laminated heater heats the fixing member.

9. An image forming apparatus comprising the fixing device according to claim 1.

10. A fixing device comprising:

an endless belt-shaped fixing member rotating in a predetermined direction of rotation, formed into a loop, a nip formation member provided inside the loop formed by the fixing member;

a pressing member provided outside the loop formed by the fixing member to press the fixing member against the nip formation member to form a nip between the pressing member and the fixing member;

a laminated heater contacting an inner circumferential surface of the fixing member to generate heat to be transmitted to the fixing member;

a heater support provided inside the loop formed by the fixing member and including a first surface that supports the laminated heater in a state in which the laminated heater is provided between the fixing member and the heater support and a second surface disposed back-to-back to the first surface, the heater support thermally expanding in a first direction due to heat generated by the laminated heater;

a support member fixedly provided inside the loop formed by the fixing member and isolated from the second surface of the heater support;

a biasing member provided between the support member and the second surface of the heater support to apply bias to the heater support in a second direction opposite the first direction and in which the heater support presses the laminated heater against the inner circumferential surface of the fixing member;

a fixing member temperature detector facing the fixing member at a position at which the fixing member contacts the laminated heater to detect a temperature of the fixing member; and a controller connected to the fixing member temperature detector to control power supplied to the laminated heater based on the temperature of the fixing member detected by the fixing member temperature detector as the laminated heater heats the fixing member;

wherein when the temperature of the fixing member detected by the fixing member temperature detector is lower than a predetermined first temperature as the laminated heater heats the fixing member, the controller adjusts an upper limit of power supplied to the laminated heater to be smaller than an upper limit thereof when the temperature of the fixing member detected by the fixing member temperature detector is not lower than the predetermined first temperature.

11. The fixing device according to claim 10, further comprising a lubricant applied to the inner circumferential surface of the fixing member.

12. The fixing device according to claim 10, wherein the laminated heater comprises a flexible heat generation sheet having a predetermined width in an axial direction of the fixing member and a predetermined length in a circumferential direction of the fixing member, the heat generation sheet comprising:

an insulating base layer;

a resistant heat generation layer provided on the base layer to generate heat and including conductive particles dispersed in a heat-resistant resin; and an electrode layer provided on the base layer to supply power to the resistant heat generation layer.

13. The fixing device according to claim 10, wherein the pressing member applies pressure in a pressure application direction to the nip formation member supported by the support member, and the nip formation member, the support member, the biasing member, the heater support, and the laminated heater are aligned in this order in the pressure application direction of the pressing member.

14. The fixing device according to claim 10, further comprising a stopper provided between the support member and the second surface of the heater support to restrict thermal expansion of the heater support in the first direction a controller connected to the fixing member temperature detector to control power supplied to the laminated heater based on the temperature of the fixing member detected by the fixing member temperature detector as the laminated heater heats the fixing member.

15. The fixing device according to claim 10, further comprising an ambient temperature detector provided outside a frame of the fixing device to detect an ambient temperature near the fixing device, wherein the controller changes power supplied to the laminated heater based on the temperature of the fixing member detected by the fixing member temperature detector and the ambient temperature detected by the ambient temperature detector as the laminated heater heats the fixing member.

16. An image forming apparatus comprising the fixing device according to claim 10.

17. A fixing device comprising:

an endless belt-shaped fixing member rotating in a predetermined direction of rotation, formed into a loop;

a nip formation member provided inside the loop formed by the fixing member;

a pressing member provided outside the loop formed by the fixing member to press the fixing member against the nip formation member to form a nip between the pressing member and the fixing member;

a laminated heater contacting an inner circumferential surface of the fixing member to generate heat to be transmitted to the fixing member;

a heater support provided inside the loop formed by the fixing member and including a first surface that supports the laminated heater in a state in which the laminated heater is provided between the fixing member and the heater support and a second surface disposed back-to-back to the first surface, the heater support thermally expanding in a first direction due to heat generated by the laminated heater;

a support member fixedly provided inside the loop formed by the fixing member and isolated from the second surface of the heater support; and a biasing member provided between the support member and the second surface of the heater support to apply bias to the heater support in a second direction opposite the first direction and in which the heater support presses the laminated heater against the inner circumferential surface of the fixing member;

a fixing member temperature detector facing the fixing member at a position which the fixing member contacts the laminated heater to detect a temperature of the fixing member; and a controller connected to the fixing member temperature detector to control power supplied to the laminated heater based on the temperature of the fixing member detected by the fixing member temperature detector as the laminated heater heats the fixing member;

an ambient temperature detector provided outside a frame of the fixing device to detect an ambient temperature near the fixing device, wherein the controller changes power supplied to the laminated heater based on the temperature of the fixing member detected by the fixing member temperature detector and the ambient temperature detected by the ambient temperature detector as the laminated heater heats the fixing member, wherein when the temperature of the fixing member detected by the fixing member temperature detector is lower than a predetermined first temperature as the laminated heater heats the fixing member, the controller adjusts an upper limit of power supplied to the laminated heater to be smaller than an upper limit thereof when the temperature of the fixing member detected by the fixing member temperature detector is not lower than the predetermined first temperature, and at the same time when the ambient temperature detected by the ambient temperature detector is lower than a predetermined second temperature, the controller adjusts the upper limit of power supplied to the laminated heater to be smaller than the upper limit thereof when the ambient temperature detected by the ambient temperature detector is not lower than the predetermined second temperature.

18. The fixing device according to claim 17, further comprising a lubricant applied to the inner circumferential surface of the fixing member.

19. The fixing device according to claim 17, wherein the laminated heater comprises a flexible heat generation sheet having a predetermined width in an axial direction of the fixing member and a predetermined length in a circumferential direction of the fixing member, the heat generation sheet comprising:

an insulating base layer;

a resistant heat generation layer provided on the base layer to generate heat and including conductive particles dispersed in a heat-resistant resin; and an electrode layer provided on the base layer to supply power to the resistant heat generation layer.

20. The fixing device according to claim 17, wherein the pressing member applies pressure in a pressure application direction to the nip formation member supported by the support member, and the nip formation member, the support member, the biasing member, the heater support, and the laminated heater are aligned in this order in the pressure application direction of the pressing member.

21. The fixing device according to claim 17, further comprising a stopper provided between the support member and the second surface of the heater support to restrict thermal expansion of the heater support in the first direction.

22. An image forming apparatus comprising the fixing device according to claim 17.

* * * * *